US007941959B1

(12) United States Patent
Swan

(10) Patent No.: US 7,941,959 B1
(45) **Date of Patent: *May 17, 2011**

(54) MODULAR INTEGRATED RAIL ASSEMBLY FOR FIREARMS

(76) Inventor: Richard E. Swan, E. Bridgewater, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/717,360

(22) Filed: Mar. 4, 2010

Related U.S. Application Data

(63) Continuation of application No. 11/296,099, filed on Dec. 7, 2005, now Pat. No. 7,707,762, which is a continuation-in-part of application No. 29/237,440, filed on Aug. 31, 2005, now Pat. No. Des. 544,564.

(60) Provisional application No. 60/641,694, filed on Jan. 5, 2005.

(51) Int. Cl.
*F41C 27/06* (2006.01)
*F41C 27/00* (2006.01)

(52) U.S. Cl. ..... 42/85; 42/72; 42/105

(58) Field of Classification Search ..... 42/71.01, 42/72, 85, 105

See application file for complete search history.

(56) References Cited

U.S. PATENT DOCUMENTS

| | | | |
|---|---|---|---|
| 3,075,314 | A | 1/1963 | Bakker |
| 4,536,982 | A | 8/1985 | Bredbury et al. |
| 4,663,875 | A | 5/1987 | Tatro |
| 4,689,911 | A | 9/1987 | White |
| 4,742,636 | A | 5/1988 | Swan |
| 4,845,871 | A | 7/1989 | Swan |
| 5,142,806 | A | 9/1992 | Swan |
| 5,198,600 | A | 3/1993 | E'Name |
| 5,276,988 | A | 1/1994 | Swan |
| 5,343,650 | A | 9/1994 | Swan |
| 5,533,292 | A | 7/1996 | Swan |
| 5,590,484 | A | 1/1997 | Mooney et al. |
| 5,613,316 | A | 3/1997 | Hightower |
| 5,634,288 | A | 6/1997 | Martel |
| 5,826,363 | A | 10/1998 | Olson |
| 6,453,594 | B1 | 9/2002 | Griffin |
| 6,490,822 | B1 | 12/2002 | Swan |
| 6,499,245 | B1 | 12/2002 | Swan |
| 6,618,976 | B1 | 9/2003 | Swan |
| 6,655,069 | B2 | 12/2003 | Kim |
| 6,671,990 | B1 | 1/2004 | Booth |
| 6,694,660 | B1 | 2/2004 | Davies |
| 6,779,288 | B1 | 8/2004 | Kim |
| 6,792,711 | B2 | 9/2004 | Battaglia |
| 6,839,998 | B1 | 1/2005 | Armstrong |
| 6,854,206 | B2 | 2/2005 | Oz |

(Continued)

*Primary Examiner* — Bret Hayes
(74) *Attorney, Agent, or Firm* — Barlow, Josephs & Holmes, Ltd.

(57) ABSTRACT

A modular integrated rail system for a firearm includes an upper hand guard having a dovetail rail extending longitudinally between the forward end and the rearward end thereof. The rearward end of the upper hand guard includes a clamp that removably secures the upper hand guard to the barrel nut of the firearm. The rearward end of the upper hand guard and the clamp include clamping surfaces configured to cooperatively engage the outer surface of the barrel nut. The upper hand guard further includes mounting channels that are used to mount accessories, such as a lower hand guard or a grenade launcher, to the upper hand guard. The rear end of the upper hand guard includes alignment tabs for automatically aligning the dovetail rail of the upper hand guard with the dovetail rail of the upper receiver during mounting. The tabs also prevent rotation of the rail system relative to the upper receiver during use.

18 Claims, 21 Drawing Sheets

U.S. PATENT DOCUMENTS

| | | | | |
|---|---|---|---|---|
| 6,895,708 | B2 | 5/2005 | Kim et al. | |
| D507,620 | S | 7/2005 | Swan | |
| 7,059,076 | B2 | 6/2006 | Stoner et al. | |
| 7,216,451 | B1 | 5/2007 | Troy | |
| D544,564 | S | 6/2007 | Swan | |
| 7,458,179 | B2 | 12/2008 | Swan | |
| 7,707,762 | B1 * | 5/2010 | Swan | 42/85 |
| 2005/0241211 | A1 | 11/2005 | Swan | |
| 2006/0260169 | A1 | 11/2006 | Samson et al. | |
| 2007/0199435 | A1 | 8/2007 | Hochstrate et al. | |

* cited by examiner

MODULAR INTEGRATED RAIL ASSEMBLY FOR FIREARMS

CROSS-REFERENCE TO RELATED APPLICATIONS

This application is related to and claims priority from earlier filed U.S. Provisional Patent Application No. 60/641,694, filed Jan. 5, 2005.

This application is continuation of co-pending U.S. application Ser. No. 11/296,099, filed Dec. 7, 2005 which is a continuation-in-part of U.S. Design Pat. D544564 filed Aug. 31, 2005 and issued Jun. 12, 2007.

BACKGROUND OF THE INVENTION

The present invention relates generally to modular interface assemblies for weapons. More specifically, the present invention relates to a modular interface assembly that includes a rail system, which is clamped around and supported by the barrel nut of a firearm and further includes an optional sleeve element that can be installed to extend from the upper receiver rail over the top of the clamped rail system.

As the field of combat and commercial weaponry expands, numerous add-on enhancements have become available for attachment to standard firearms, thereby significantly upgrading the capability of the firearm. Of particular interest in the area of combat weapons is the well-known M16/M4 weapon system generally indicated at 10 in FIG. 1 (M16 and M4 are trademarks of Colt Defense, Inc.). The M16 has been in service for a number of years and will continue to be a popular rifle both in U.S. and foreign militaries for the foreseeable future. Generally, the M16/M4 weapon 10 includes a lower receiver 12, upper receiver 14, butt stock 16, and barrel 18. Referring to FIGS. 1 and 2, the barrel 18 is attached to the front of the upper receiver 14 by inserting the rear end of the barrel into a barrel-receiving receptacle 20 at the front end of the upper receiver 14. A pin 22 on the barrel 18 aligns with a notch 24 in the barrel-receiving receptacle 20 to insure that the barrel 18 is properly aligned with the upper receiver 14 when the barrel is installed into the barrel-receiving receptacle 20. The barrel 18 is held in assembled relation with the upper receiver 14 by a barrel nut 26 that is threaded onto the outside surface of the barrel-receiving receptacle 20. In this manner, the barrel nut 26 is rigidly engaged with the barrel receiving receptacle 20 and the upper receiver 14 of the weapon 10, while also serving to retain the barrel 18 in its installed position. A "delta ring" 28 (FIG. 1) encircles the barrel nut 26 and provides a spring loaded ring for attachment and support of the M16/M4 standard hand guards (not shown) between the delta ring 28 and a forward receptor cap 32 mounted at the front end of the barrel 18. A gas tube 29 extends from the upper receiver 14 to the receptor cap 32 at the front end of the barrel 18. The standard hand guards, when installed, encircle and protect both the barrel 18 and gas tube 29.

The newer models of the M16/M4 weapons 10 further include a mil-std 1913 dovetail rail 30 extending along the top of the upper receiver 14. This integrated receiver rail 30 provides a convenient mounting point for many types of enhancement devices such as scopes and other sighting devices. However, space on the upper receiver rail is limited, and many military personnel often have multiple sighting devices that are each tailored to perform in different combat situations. In addition, there are a variety of lighting devices, handgrips, etc. that could also be attached to the weapon 10 for enhanced use of the weapon 10. The difficulty is that there is simply not enough space on the integrated rail 30 provided on the upper receiver 14 to accommodate all of the desired accessories. Accordingly, the increasing development and refinement of laser sights, infrared lighting, visible lighting, night vision, and specialized scopes and magnifiers, and other accessories continues to drive the need for versatile and reliable integration systems that include additional mil-std 1913 dovetail rails positioned above or around the barrel 18 of the weapon 10 that can support this important equipment and yet stand the test of rugged military use and abuse.

As can be appreciated, the problem in attempting to meet this requirement by integrating a variety of modular attachments onto firearms is the inherent conflict between the unimpeded function of the gun barrel 18 and the desirability to be able to use the barrel 18 and/or other parts of the weapon 10 as a mounting platform for the desired modular attachments. The conflict arises from the fact that any additional weight and/or shocks that may be applied to the barrel from external attachments and accessories can adversely affect the alignment and reliable function of the weapon. It is also a requirement of most military contract specifications that the existing weapon not be modified for the purpose of mounting accessories to the weapon, thus insuring that such integration systems can be used universally on all existing weapons.

Accordingly, it has been realized that to obtain the best and most reliable performance of a rifle, the gun barrel 18 should be physically isolated relative to any other accessories or mounting systems, i.e., "free floating". It is most preferred that nothing be attached to the gun barrel 18, thereby isolating the gun barrel 18 physically from outside elements and eliminating any bending and "droop" along the longitudinal axis of the barrel 18 that may be caused by excess weight near the front end of the barrel. The ideal mounting arrangement for modular attachments is one where the attachment is completely isolated from the gun barrel. This isolation serves two functional purposes. First, in operation, the temperature of a gun barrel can quickly rise to 900° F. This type of heat, as well as the physical shock transferred through the gun barrel during firing, can damage or destroy any attachments that are mounted in direct contact with the barrel. Additionally, the heat generated by the gun barrel is transferred to any devices mounted thereon, such as hand guards, thereby resulting in the direct transfer of enough heat to burn a user's hands and to potentially interfere with the operation of other attachments. The second issue compounding this problem is that if accessories are to be supported by the gun barrel, the gun barrel may need to be enlarged to support the added weight and shock forces. For example, a grenade launcher attachment not only introduces additional weight to the barrel, it also introduces substantial recoil in operation that is transferred into the firearm through the barrel. This in turn means more cantilevered stress on the barrel where it is joined with the upper receiver. The combination of heat and force applied to the barrel tends to pull the barrel chamber out of alignment with the bolt lead, thereby causing bolt lug and extractor failure, ultimately jamming the firearm.

Attempts have been made in the prior art to minimize the amount of weight that is transferred into the barrel by accessory mounts, wherein the accessory mounts are attached to both the upper receiver and the barrel. For example, U.S. Pat. No. 5,826,262 discloses a tubular rail received around the gun barrel. The rear end of the rail system is supported on the delta ring, which is secured around the barrel nut, i.e. supported on the receiver body. However, the front end of the rail system is supported on the receptor cap 32 mounted to the front end of the barrel 18 adjacent the front sight 34. Accordingly, the weight of any accessories mounted on the rail system is still partially carried by the front end of the barrel. In the case of a grenade launcher, the weight is considerable and could affect performance of the weapon.

There are also rail interface systems in the prior art that are supported directly from the upper receiver of the weapon and avoid attachment of any accessories to the gun barrel. For example, in U.S. Pat. No. 5,343,650 an extended rigid interface frame with upper and lower rails is shown joined to a firearm receiver and extends forward about the firearm's barrel to a head assembly replacing the firearm's normal front sight. A weaver type interface return portion is provided below the barrel from the head assembly to the receiver. A yoke braces the extended rigid frame receiver sleeve to the forward portion of the firearm's receiver. The distal end of the extended rigid frame receiver sleeve terminates in a front sight housing that connects the upper and lower rails and provides a housing for advanced laser and sensor components, and the standard front sight bead. The front sight housing is self-supported by the connection of the upper and lower rails running back to the yoke and secured to the top of the receiver. The barrel of the rifle is free floating in that it does not touch the extended rigid frame receiver sleeve in any manner. This permits greater shooting accuracy and protects sensitive electrical components within the front sight housing by isolating the front sight housing from the heat generated from the barrel.

In another example, the ARMS SIR system as disclosed in U.S. Pat. No. 6,499,245 also derives its support by extending a dovetail sleeve rearwardly over the dovetail rail 30 on the upper receiver 14 of the firearm and supporting the rail system in a cantilevered arrangement around the barrel (ARMS and SIR are registered trademarks of Atlantic Research Marketing Systems, Inc.). The ARMS SIR system has been well received by the military and has become popular with many military branches. However, it has been noted in field use that the dovetail sleeve introduces an added height to the existing mil-std 1913 rail of the receiver, and that this added height is not always desirable, particularly for some sighting devices that are popular with the military.

Accordingly, there is perceived to be a need for a unique modular interface rail design for mounting accessories to a firearm that supports the accessory without introducing loads or additional stresses into the barrel of the firearm while also providing an extended longitudinal rail for mounting accessories that is co-planar and in linear alignment with the existing interface rail 30 on the upper receiver 14 over the entire length of the top of the firearm, and in addition providing an optional sleeve over the upper receiver 14 for added height if desired.

SUMMARY OF THE INVENTION

In this regard, the present invention provides for modular sleeve and hand guard system for mounting to a firearm that includes an integrated interface system for mounting attachments thereto. As such, the general purpose of the present invention, which will be described subsequently in greater detail, is to provide a new and improved interface means for mounting a modular interface onto firearms without attaching them directly to the gun barrel.

The modular integrated rail system for a firearm generally includes an upper hand guard, a lower firearm accessory, and an optional dovetail sleeve.

The upper hand guard is the main structural element of the system. The upper hand guard is generally semi-cylindrical in shape and has a forward end and a rearward end and a mil-std 1913 dovetail rail extending longitudinally between the forward end and the rearward end. The semi-cylindrical upper hand guard further includes symmetrically opposing side walls that extend outwardly and downwardly from the dovetail rail and terminate in symmetrically opposing longitudinally extending mounting channels. The mounting channels are used to mount various accessories, such as a lower hand guard or a grenade launcher, to the upper hand guard.

A clamp is provided at the rearward end of the upper hand guard to removably secure the upper hand guard to the barrel nut of the firearm. The clamp is generally semi-cylindrical in shape with two flanges extending outwardly to the sides. Fasteners extend through aligned openings in the flanges and the opposing sidewalls of the upper hand guard to draw the clamp and upper hand guard together. The rearward end of the upper hand guard and the clamp include inner clamping surfaces configured to cooperatively engage the outer surfaces of the barrel nut as well as encircle the toothed flange of the barrel nut. In particular, a circular groove is formed in each of the clamping surfaces to accommodate the toothed flange on the barrel nut. The front end of the clamp further includes an extended support shelf to further reduce bending moments as added weight is applied to the forward end of the upper hand guard.

With this unique mounting arrangement, the upper hand guard extends from the forward end of the upper receiver forwardly above the barrel of the firearm without engaging the barrel. All of the weight of the upper hand guard, as well as the weight of the lower firearm accessories that will be attached to the upper hand guard is effectively cantilevered about the front end of the upper receiver without engaging the barrel of the firearm.

When the upper hand guard is assembled with the upper receiver, the dovetail rail of the upper hand guard is arranged so that it extends forwardly in linear alignment with the dovetail rail of the upper receiver to form a continuous rail extending over the barrel. In order to provide automatic alignment of the dovetail rail on the upper hand guard with the dovetail rail on the upper receiver, alignment structures (tabs) are provided at the rear end of the upper hand guard. The alignment tabs extend rearwardly and are configured to engage the side walls of the upper receiver to provide automatic alignment during mounting and to prevent rotation of the upper hand guard relative to the upper receiver during use.

The lower firearm accessory can be one of many different types of accessories, such as a lower hand guard or a grenade launcher, wherein the lower firearm accessory includes symmetrically opposing mating formations for removably securing the lower firearm accessory to the mounting channels in the upper hand guard. In the preferred embodiments as described herein, the mating formations comprise projections that are slidably received within the mounting channels.

To make the upper hand guard compatible with lower hand guards of prior rail systems, such as those produced by the applicant, the lower wall of the mounting channel is provided with interrupted wall segments. However, the system need not include the interrupted wall segments.

In another embodiment, the integrated rail system further includes an optional dovetail sleeve configured to be clamped onto the aligned dovetail rails of the upper receiver and upper hand guard. The upper surface of the sleeve includes a mil-std 1913 dovetail rail to provide an elevated optics platform while the lower surface includes a dovetail channel that rigidly clamps over the aligned dovetail rails of the upper receiver and upper hand guard to further prevent rotation of the upper hand guard relative to the upper receiver in the event of an impact.

Accordingly, among the objects of the present invention are: the provision of a new and improved modular integrated rail system for mounting a modular accessory onto a firearm without attaching either the rail system or the accessory directly to the gun barrel; the provision of a modular integrated rail system that supports the accessories without introducing loads or additional stresses into the barrel of the firearm; the provision of an extended longitudinal rail for mounting accessories that is co-planar and aligned with the existing dovetail rail on the upper receiver over the entire length of the top of the firearm; the provision of means for automatically aligning the dovetail rail of the upper hand guard with the dovetail rail of the upper receiver during mounting on the weapon; the provision of means for maintaining alignment of the dovetail rail of the upper hand guard with the dovetail rail of the upper receiver during use of the weapon; and the provision of an optional sleeve to be mounted over the receiver for added height if desired.

Other objects, features and advantages of the invention shall become apparent as the description thereof proceeds when considered in connection with the accompanying illustrative drawings.

BRIEF DESCRIPTION OF THE DRAWING FIGURES

In the drawings which illustrate the best mode presently contemplated for carrying out the present invention:

DETAILED DESCRIPTION OF THE PREFERRED EMBODIMENTS

Figure 1:
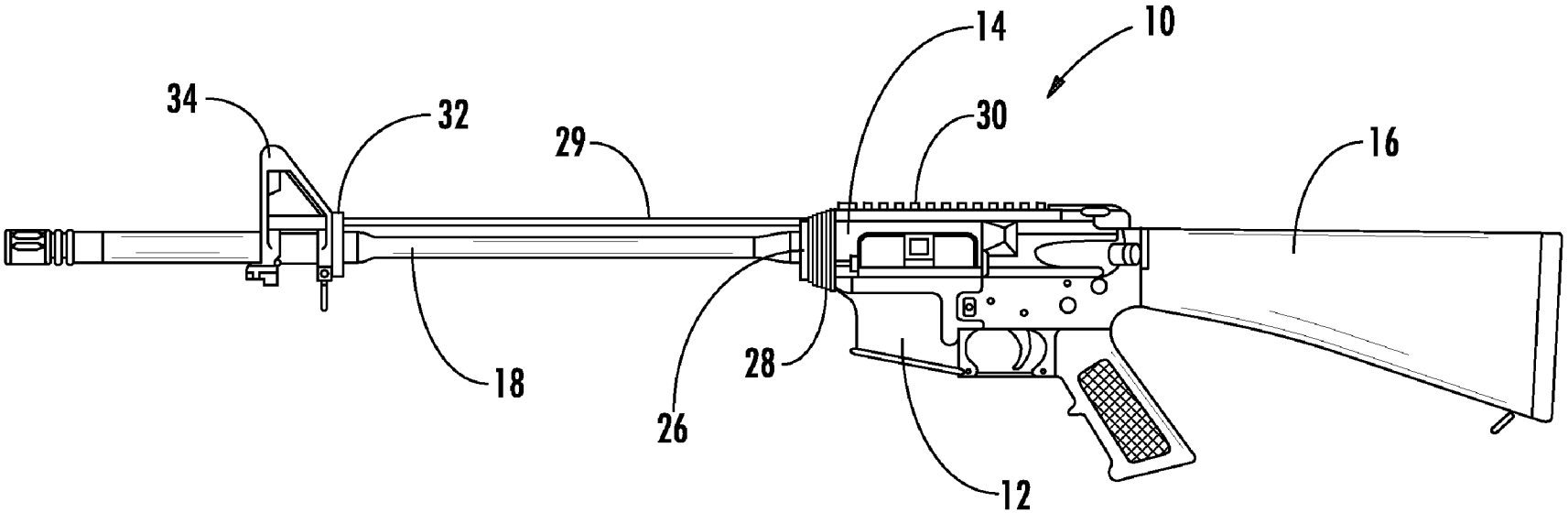
FIG. 1 is a side view of a conventional M16 firearm with the standard hand guards removed to show the barrel, barrel nut and delta ring.
Figure 2:
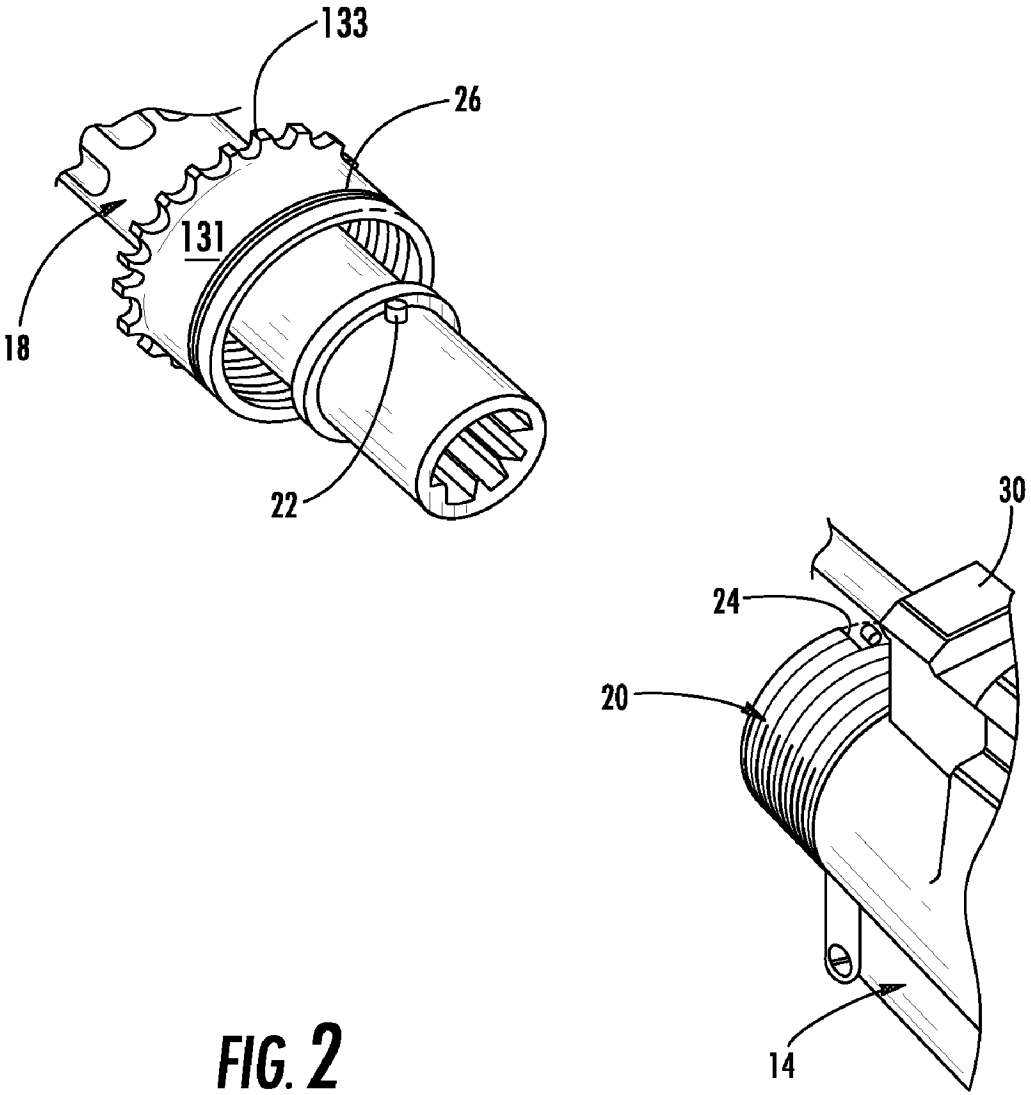
FIG. 2 is an exploded perspective view of the front end of the upper receiver, the rear end of the barrel and the barrel nut.
Figure 3:
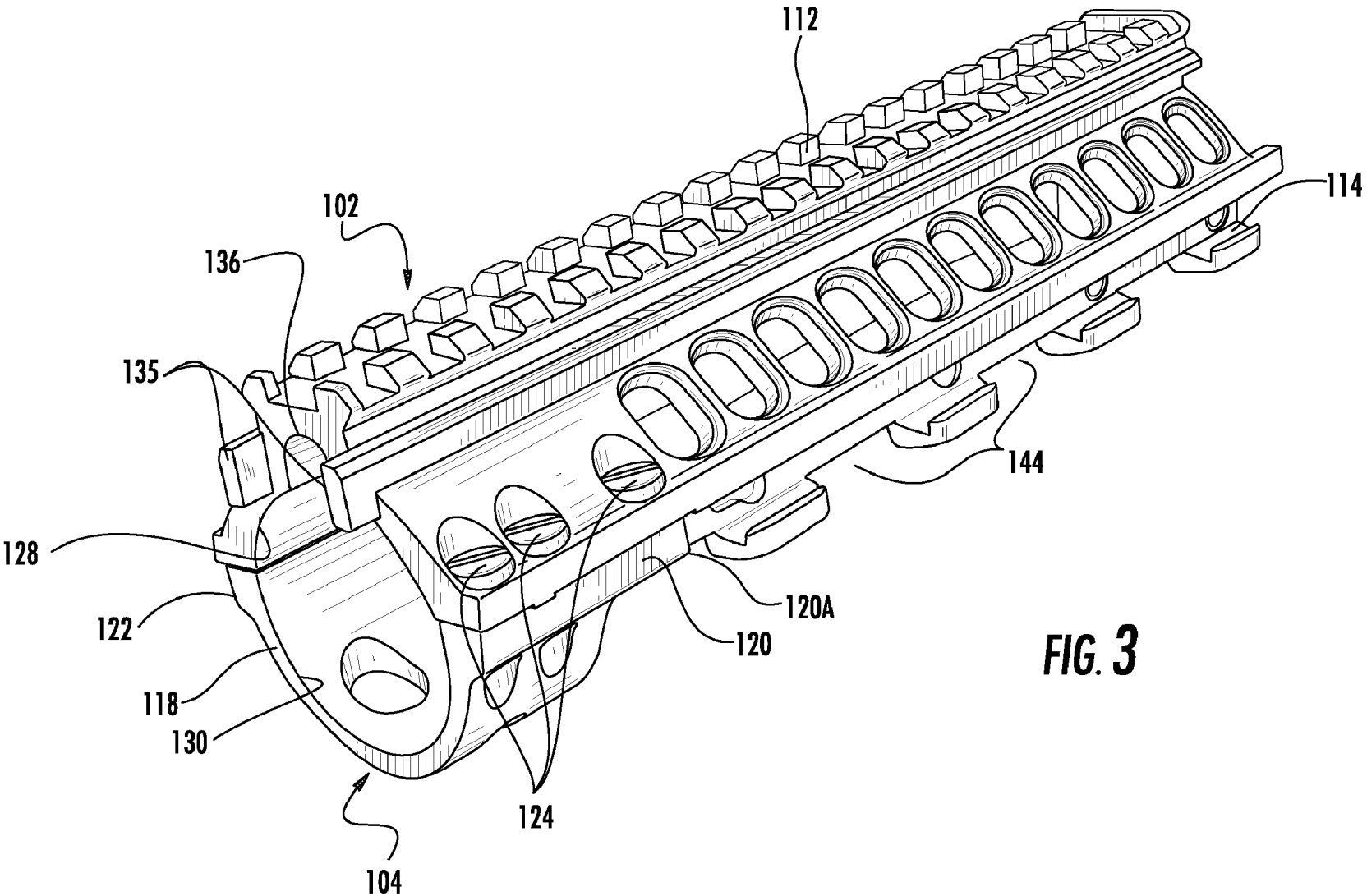
FIG. 3 is a perspective view of a first preferred embodiment of the upper hand guard assembly of the modular integrated rail system of the present invention.

Now referring to the drawings in detail, the modular integrated rail system of the instant invention is illustrated and generally indicated at 100 in FIGS. 3-15. As will hereinafter be more fully described, the present rail system 100 as illustrated is adapted for use with a conventional M4/M16 firearm 10 (M4 and M16 are trademarks of Colt Defense, LLC). However, it should be understood that the rail system 100 can be easily adapted for use with other firearms, and the disclosure herein should not limited to the M16/M4 weapon platform.

Figure 10:
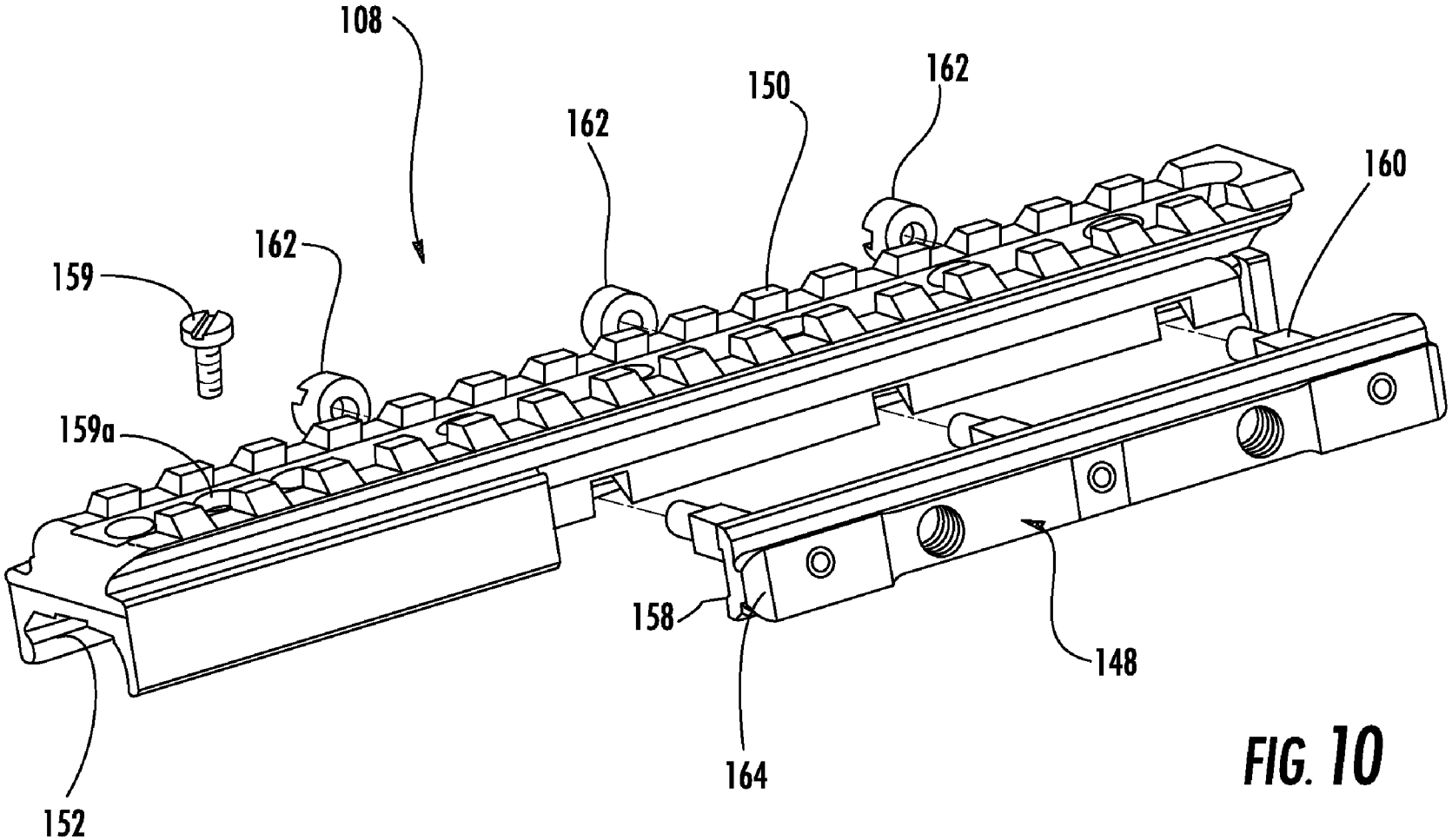
FIG. 10 is an exploded perspective view of the optional dovetail sleeve.
Figure 10A:
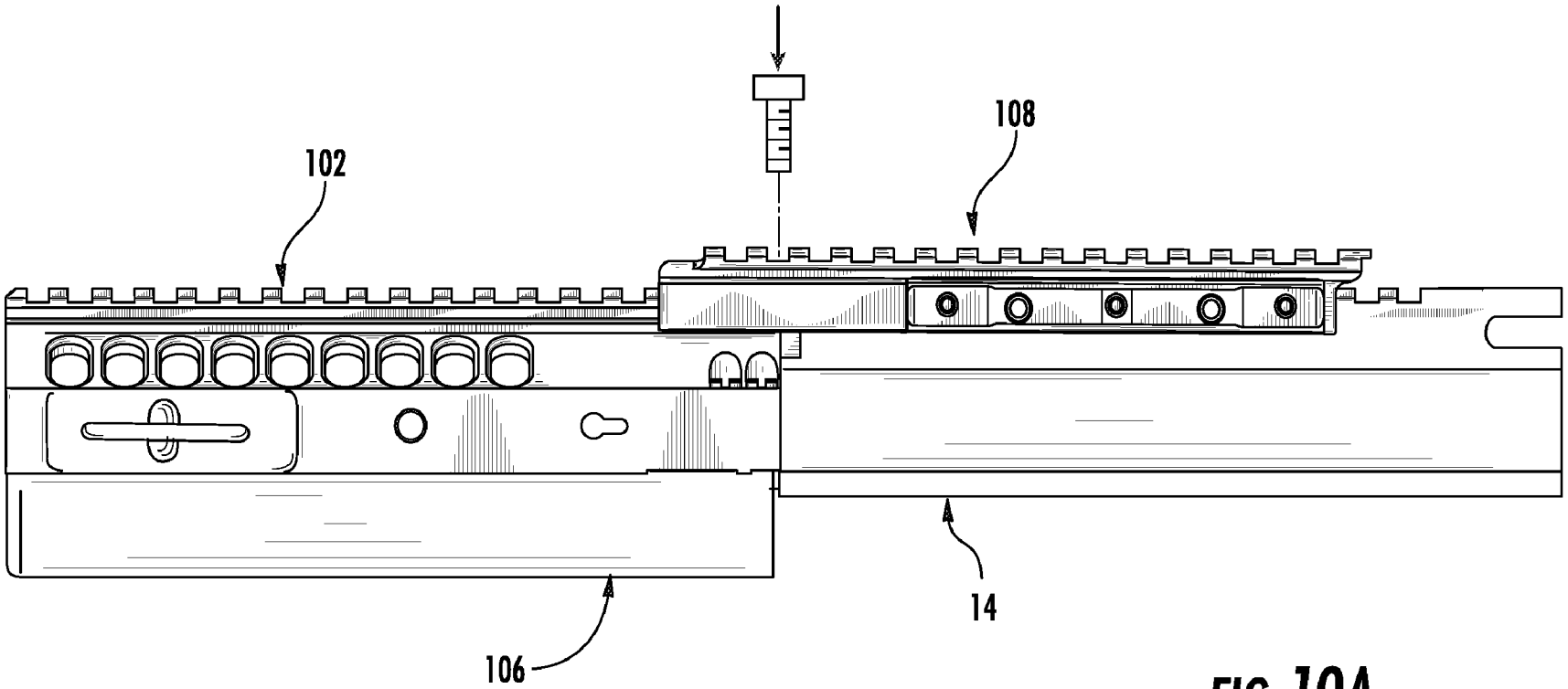
FIG. 10A is a side view of the integrated rail system showing the lower hand guard and optional dovetail sleeve assembled together.

As best shown in FIG. 10A, the modular integrated rail system 100 includes an upper hand guard generally indicated at 102, a clamp generally indicated at 104, a lower firearm accessory generally indicated at 106, and an optional dovetail sleeve generally indicated at 108.

Referring to FIGS. 3-7, the upper hand guard 102 is the main structural element of the modular integrated rail system 100. The upper hand guard 102 is generally semi-cylindrical in shape and has a forward end and a rearward end and a mil-std 1913 dovetail rail 112 extending longitudinally along the upper surface between the forward end and the rearward end. The semi-cylindrical upper hand guard 102 further includes symmetrically opposing side walls that extend outwardly and downwardly from the dovetail rail 112 and terminate in symmetrically opposing longitudinally extending mounting channels 114, 116. The mounting channels 114, 116 are used to mount various accessories, such as the lower hand guard 106, or a grenade launcher 106A (see FIG. 11), to the upper hand guard 102.

Referring more specifically to FIGS. 3, 4 6 and 7, clamp 104 is provided at the rearward end of the upper hand guard 102 to removably secure the upper hand guard 102 to the barrel nut 26 of the firearm 10. The clamp 104 includes a body portion 118 that is generally semi-cylindrical in shape, and further includes two flanges 120,122 extending outwardly to the sides. Fasteners 124 extend through aligned openings 126 in the opposing sidewalls of the upper hand guard 102 and in the flanges 120, 122 to draw the clamp 104 and upper hand guard 102 together around the barrel nut 26. The rearward end of the upper hand guard 102 and the clamp 104 include inner clamping surfaces 128, 130 configured to cooperatively engage the outer surfaces 131 of the barrel nut 26 as well as encircle the toothed flange 133 of the barrel nut 26. In particular, a circular groove 132, 134 is formed in each of the clamping surfaces 128, 130 to accommodate the toothed flange 133. The front ends of each of the flanges 120,122 of the clamp 104 include an extended support shelf 120A,122A to further reduce downward bending moments, as added weight is applied to the forward end of the upper hand guard 102. The length of the shelves 120A, 122A can be varied according to the length of the upper hand guard 102, longer hand guards (for firearms with longer barrels) would benefit from such an elongated support shelf.

With this unique mounting arrangement, the upper hand guard 102 extends from the forward end of the upper receiver 14 forwardly above the barrel 18 of the firearm 10 without engaging the barrel 18. All of the weight of the upper hand guard 102, as well as the weight of the lower firearm accessories 106 that will be attached to the upper hand guard 102 is effectively cantilevered about the front end of the upper receiver 14 without engaging the barrel 18 of the firearm.

When the upper hand guard 102 is assembled with the upper receiver 14, the dovetail rail 112 of the upper hand guard 102 is arranged so that it extends forwardly in linear alignment with the dovetail rail 30 of the upper receiver 14 to form a continuous rail structure extending over the barrel 18.

Alignment tabs 135 are provided to automatically align the dovetail rail 112 of the upper hand guard 102 with the dovetail rail 30 of the upper receiver during mounting onto the weapon 10. During use of the weapon, these same tabs 135 actively prevent rotation of the entire rail system relative to the upper receiver 14. Without the tabs 135, it would be possible for the entire rail system, which is secured to the rotatable barrel nut, to rotate relative to the upper receiver.

More specifically, the tabs 135 extend rearwardly from the rearward end of the upper hand guard 102. The tabs 135 are configured and arranged in spaced relation so as to correspond with the width of the upper receiver 14. When installed on the firearm 10, the tabs 135 extend rearwardly along the sides of the upper receiver 14 and engage opposing side surfaces of the upper receiver 14 thus preventing the upper hand guard 102 from rotating relative to the firearm 10.

Figure 4:
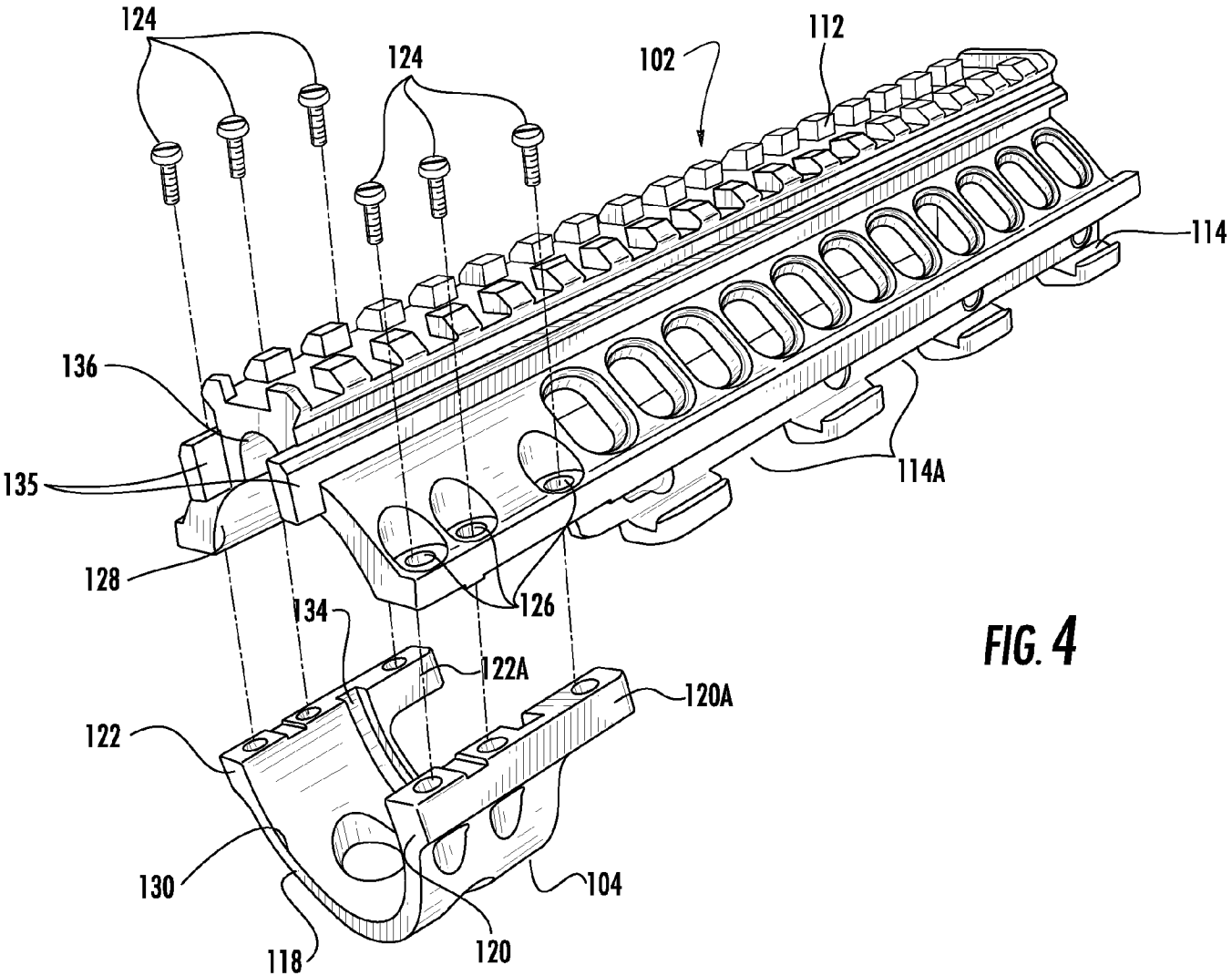
FIG. 4 is an exploded perspective view thereof.
Figure 4A:
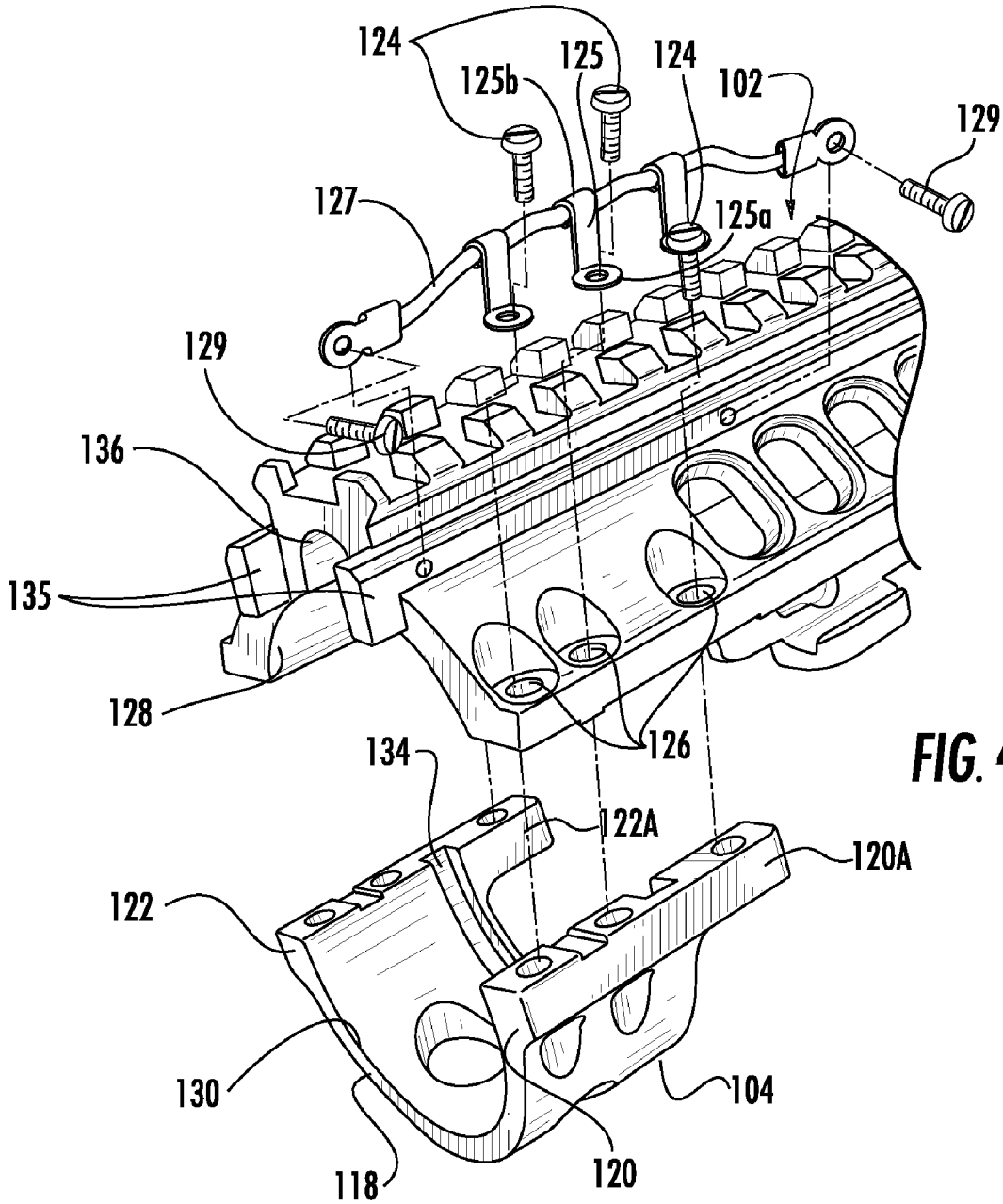
FIG. 4A is an exploded perspective view showing the use of a retaining assembly for retaining the clamp fasteners to the upper hand guard.
Figure 5:
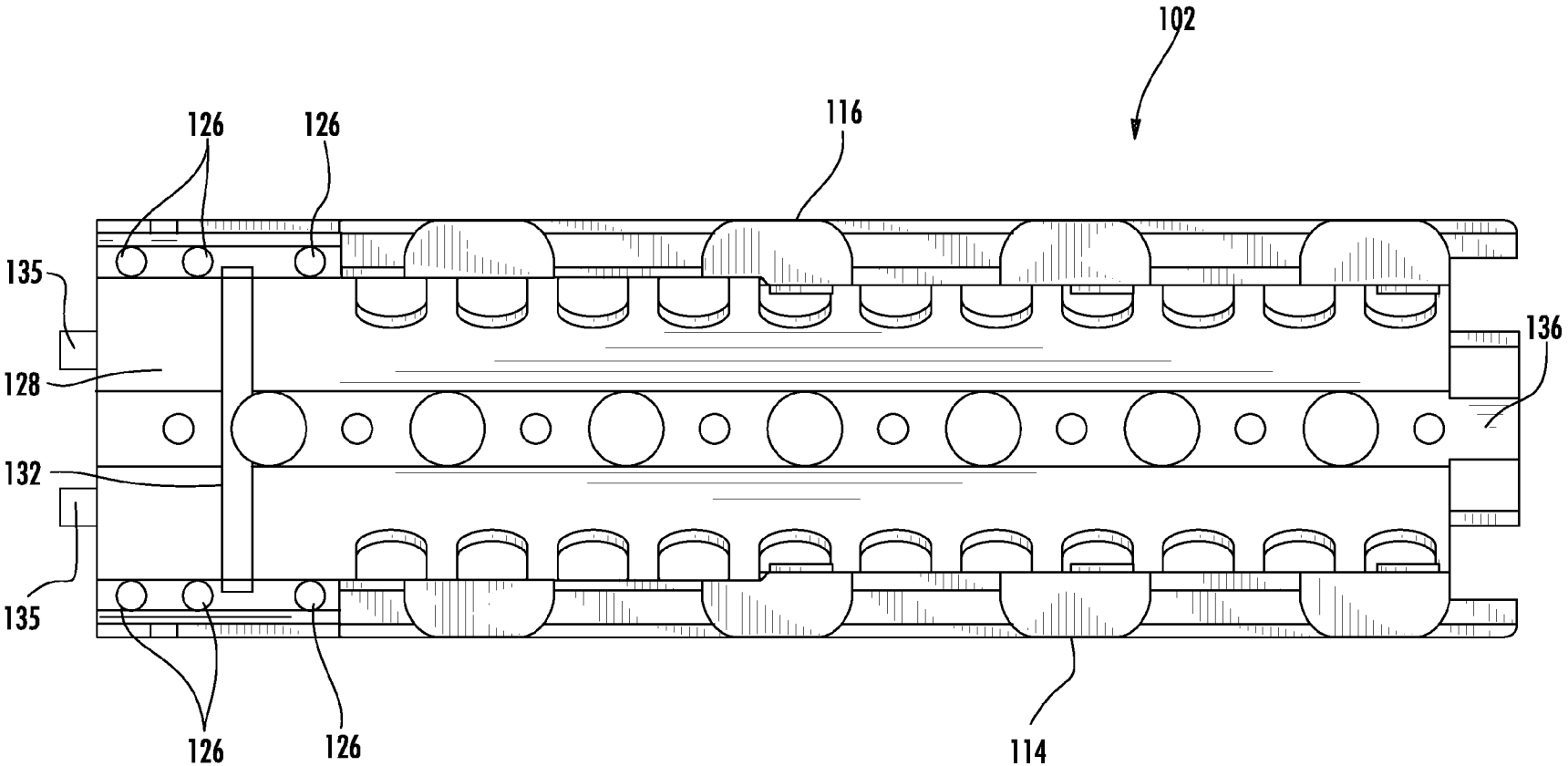
FIG. 5 is a bottom view of the upper hand guard assembly with the clamp removed.
Figure 6A:
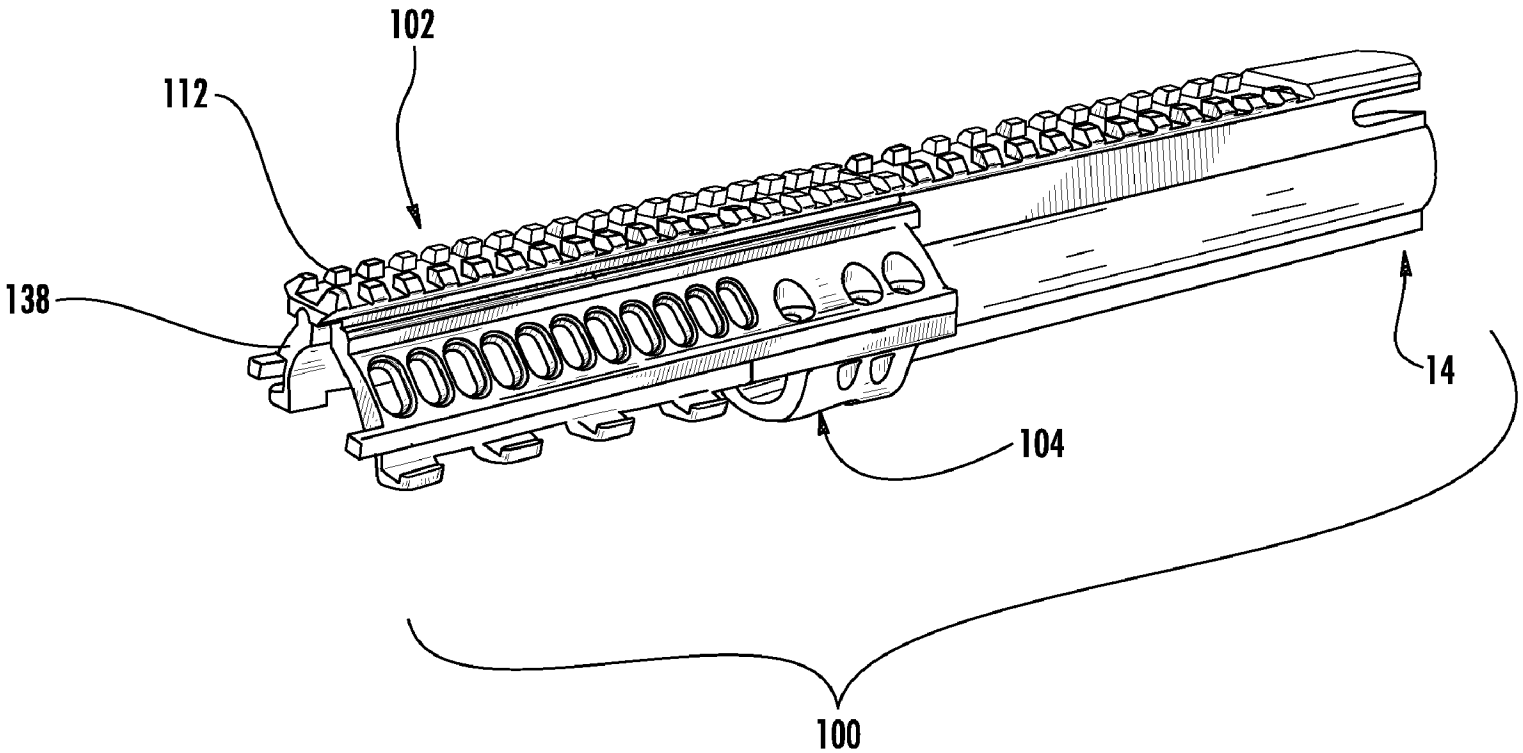
FIG. 6A is another perspective view showing the upper hand guard and clamp installed around the barrel nut on the upper receiver.
Figure 6B:
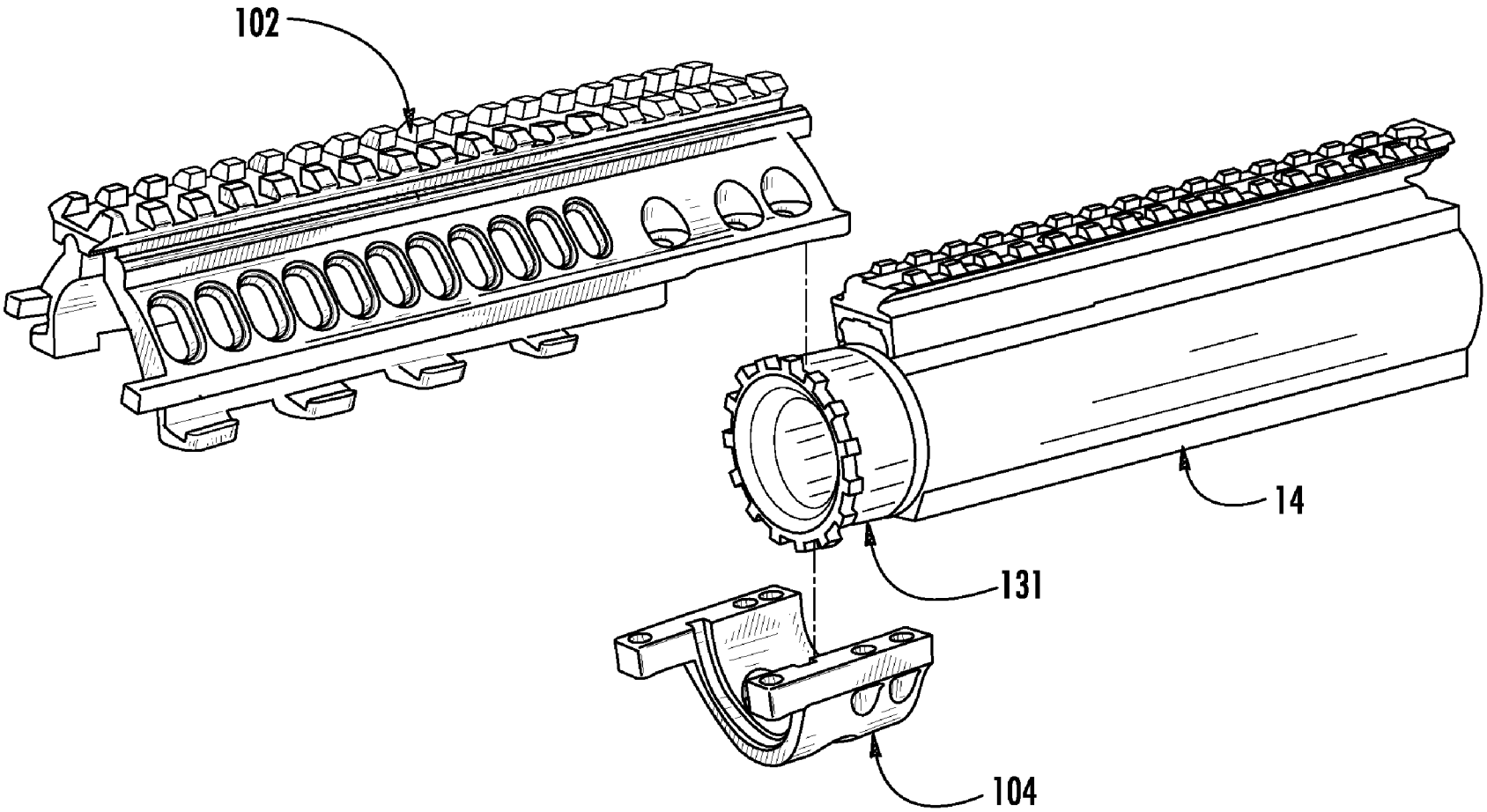
FIG. 6B is an exploded perspective view of the upper hand guard assembly with the upper receiver and barrel nut also shown.
Figure 7:
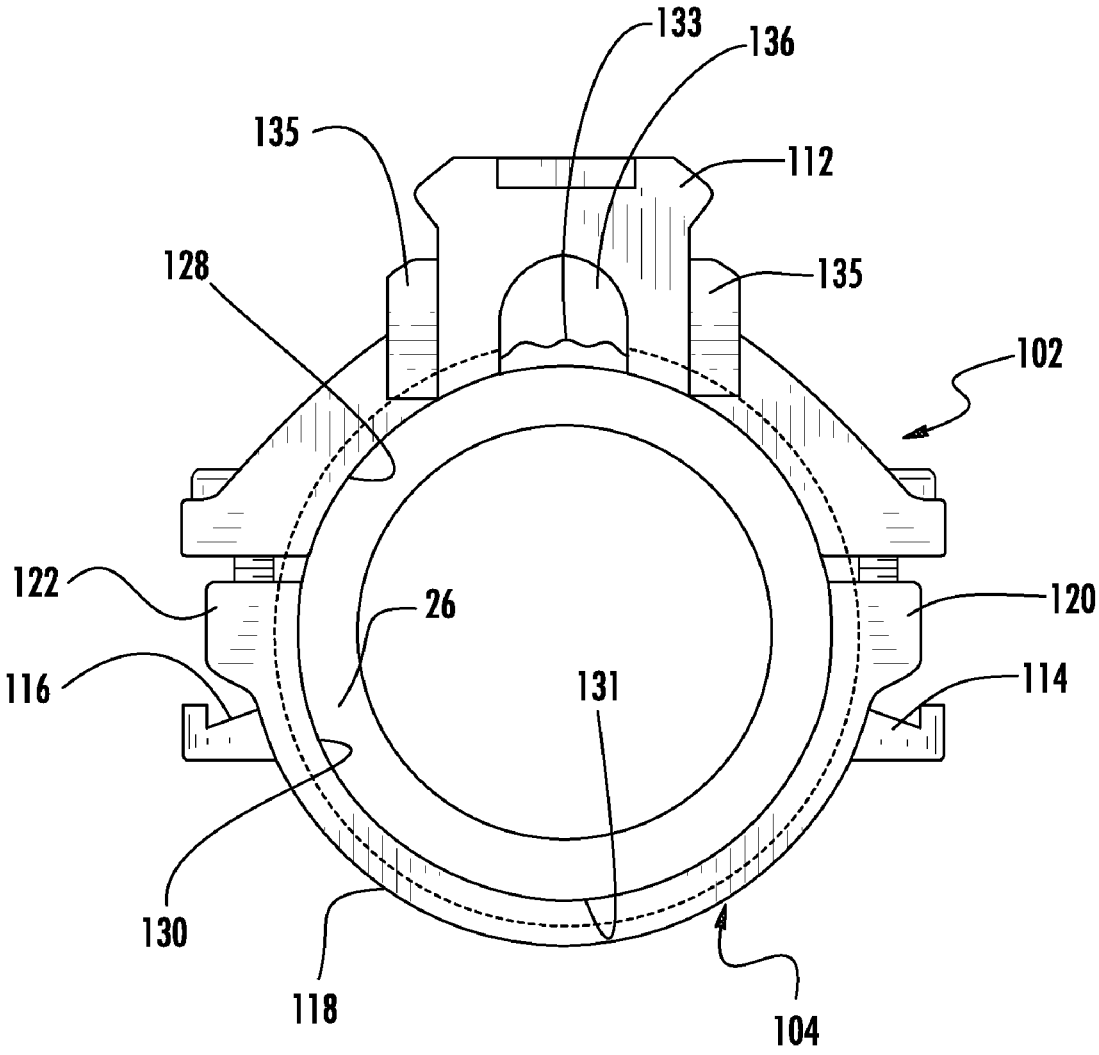
FIG. 7 is a rear end view of the upper hand guard assembly installed around a barrel nut.

Referring to FIG. 4A, it is noted that the fasteners 124 are preferably retained together in assembled relation with the upper hand guard through the use of retaining clips 125 and a retaining wire 127. The fasteners 124 are received through and captured in washer ring 125*a* at the bottom end of the retaining clip 125. The top end of the retaining clip 125 includes a sleeve 125*b*, which receives the retaining wire 127. The retaining wire 127 is threaded through the sleeves 125*b* of all of the retaining clips 125 and is secured to the upper hand guard 102, such as by fasteners 129. The retaining wire 127 may also be permanently secured to the upper hand guard by rivets or other permanent fastening means. The retaining clips 125 thus prevent loss of the fasteners 124 in the field.

It is also noted that the underside of the hand guard 102, below the dovetail rail 112, includes an elongated channel 136 for receiving and protecting the gas tube 29 of the firearm.

Figure 8:
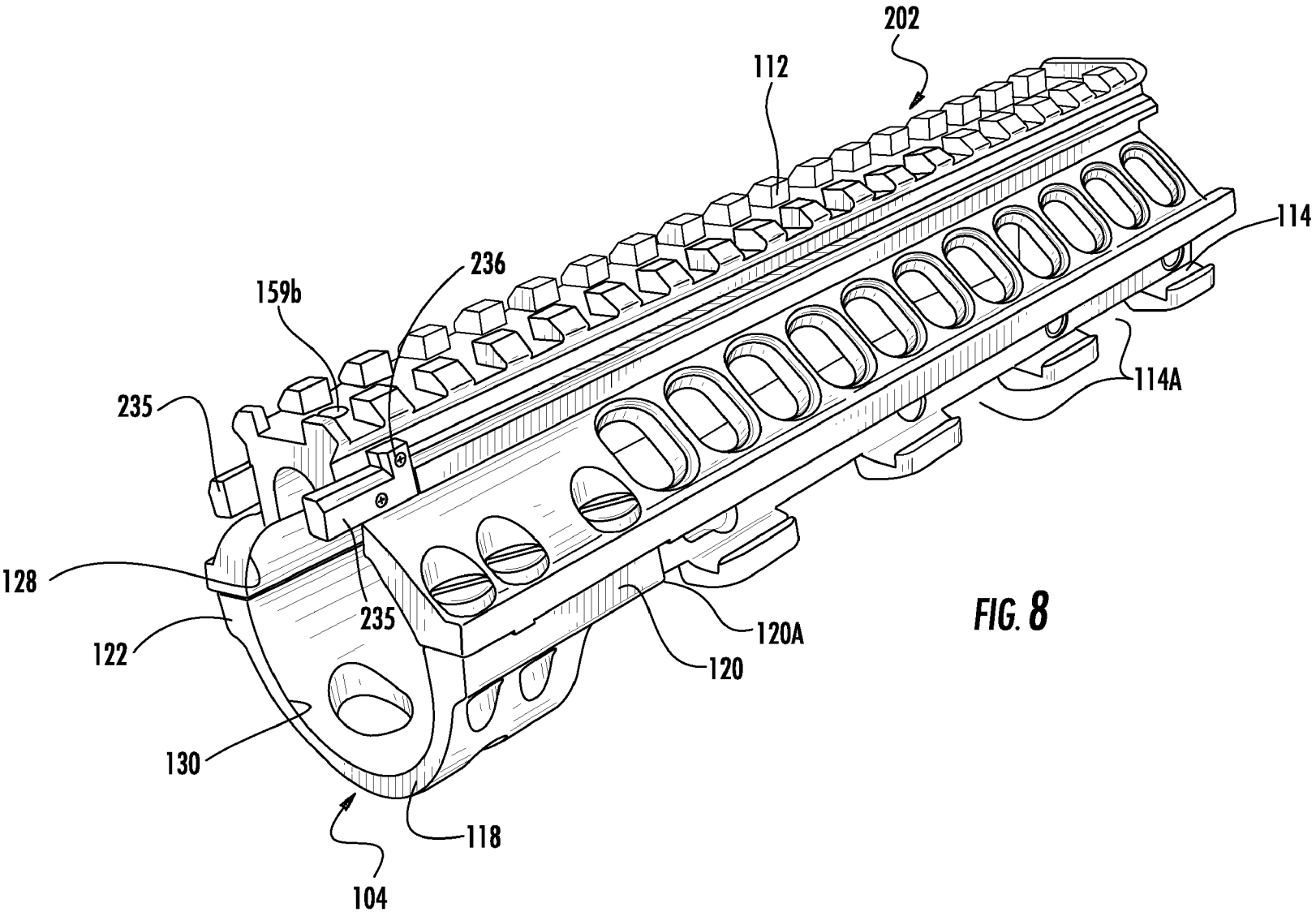
FIG. 8 is a perspective view of an alternate preferred embodiment of the upper hand guard assembly.
Figure 8A:
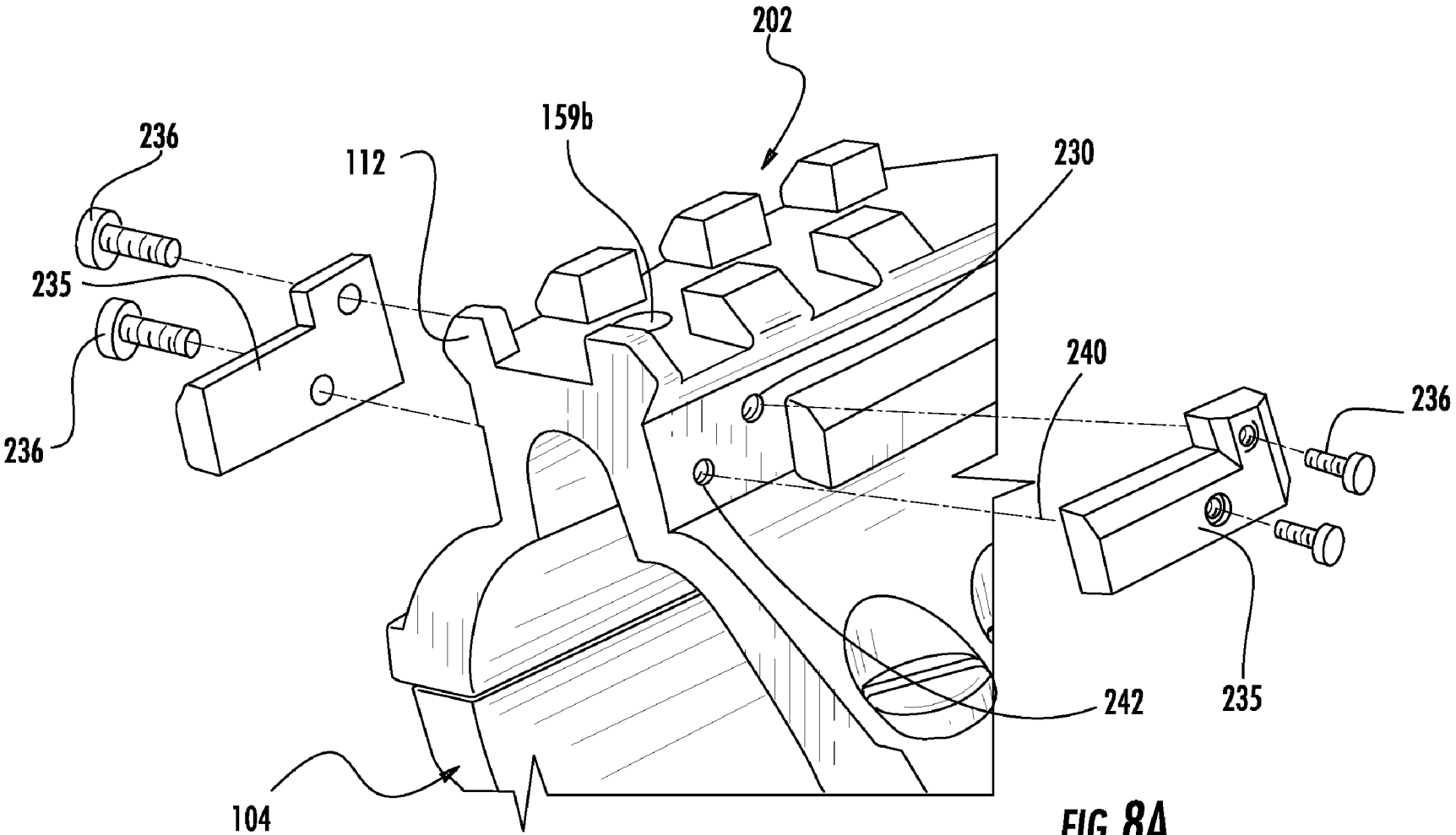
FIG. 8A is a partial exploded perspective view thereof.

Turning briefly to FIGS. 8 and 8A, an alternate preferred embodiment of the upper hand guard assembly is shown and generally indicated at 202. The alternate preferred embodiment 202 is substantially identical to the first preferred embodiment with the noted exception of having adjustable anti-rotation tabs 235. Since the width of the upper receiver 14 may vary slightly from firearm to firearm, the tabs 235 are configured and arranged to be adjustable and/or removable. In this configuration, the tabs 235 are attached to the rearward portion of the upper hand guard assembly 202 using screws 236 that engage threaded openings 238 in the upper hand guard 202. This allows the tabs 235 to be adjusted and repositioned as required to accommodate an upper receiver 14 that may not be of the correct dimension.

Figure 8B:
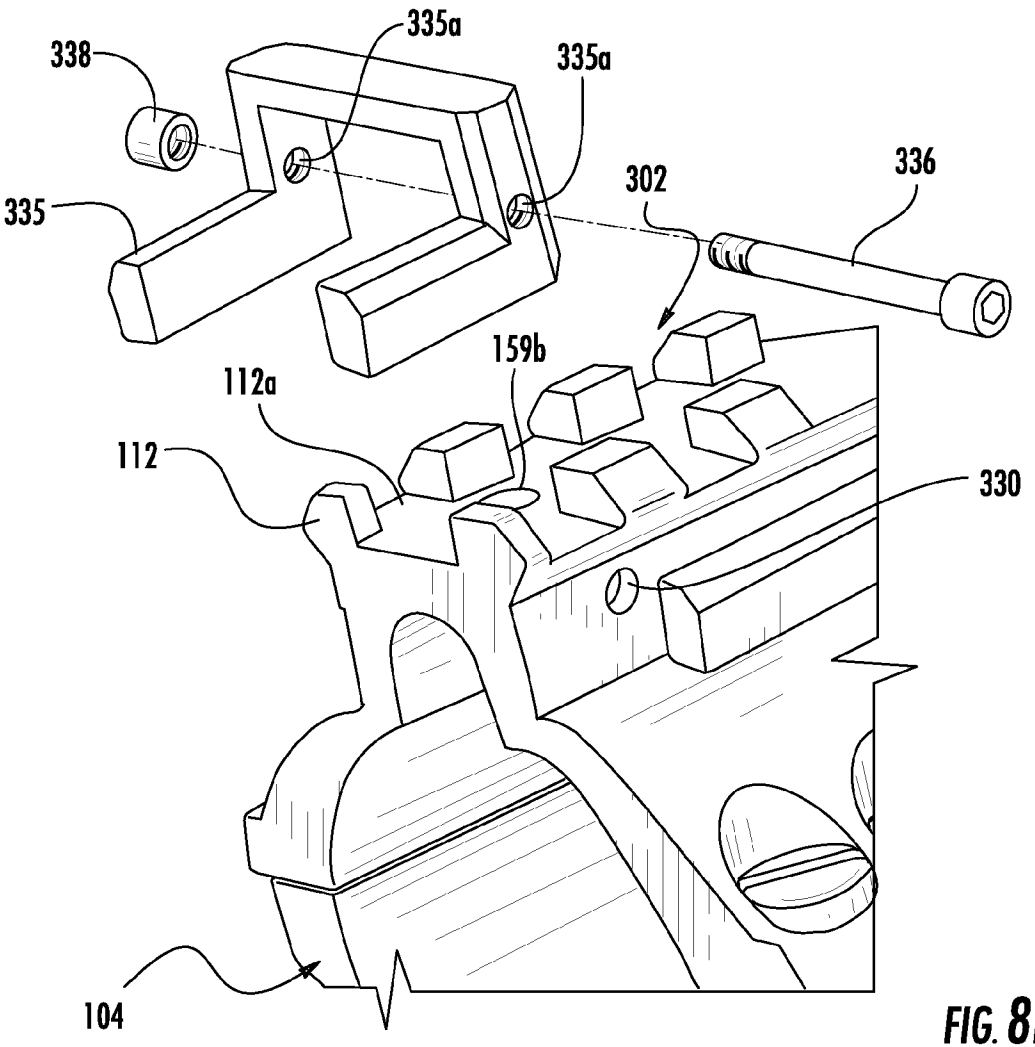
FIG. 8B is a partial exploded perspective view of a second alternate preferred embodiment.

FIG. 8B shows a second alternate design of the hand guard assembly generally indicated at 302. The alternate preferred embodiment 202 is also substantially identical to the first preferred embodiment, but utilizes a single U-shaped saddle tab 335 that sits over the top of the upper rail within the first cross channel 112*a*. The saddle tab 335 employs an elongated bolt 336 and nut assembly 338 that extends through an aperture 330 in the upper hand guard assembly 302 and through corresponding apertures 335*a* in the tabs 335.

Figure 9:
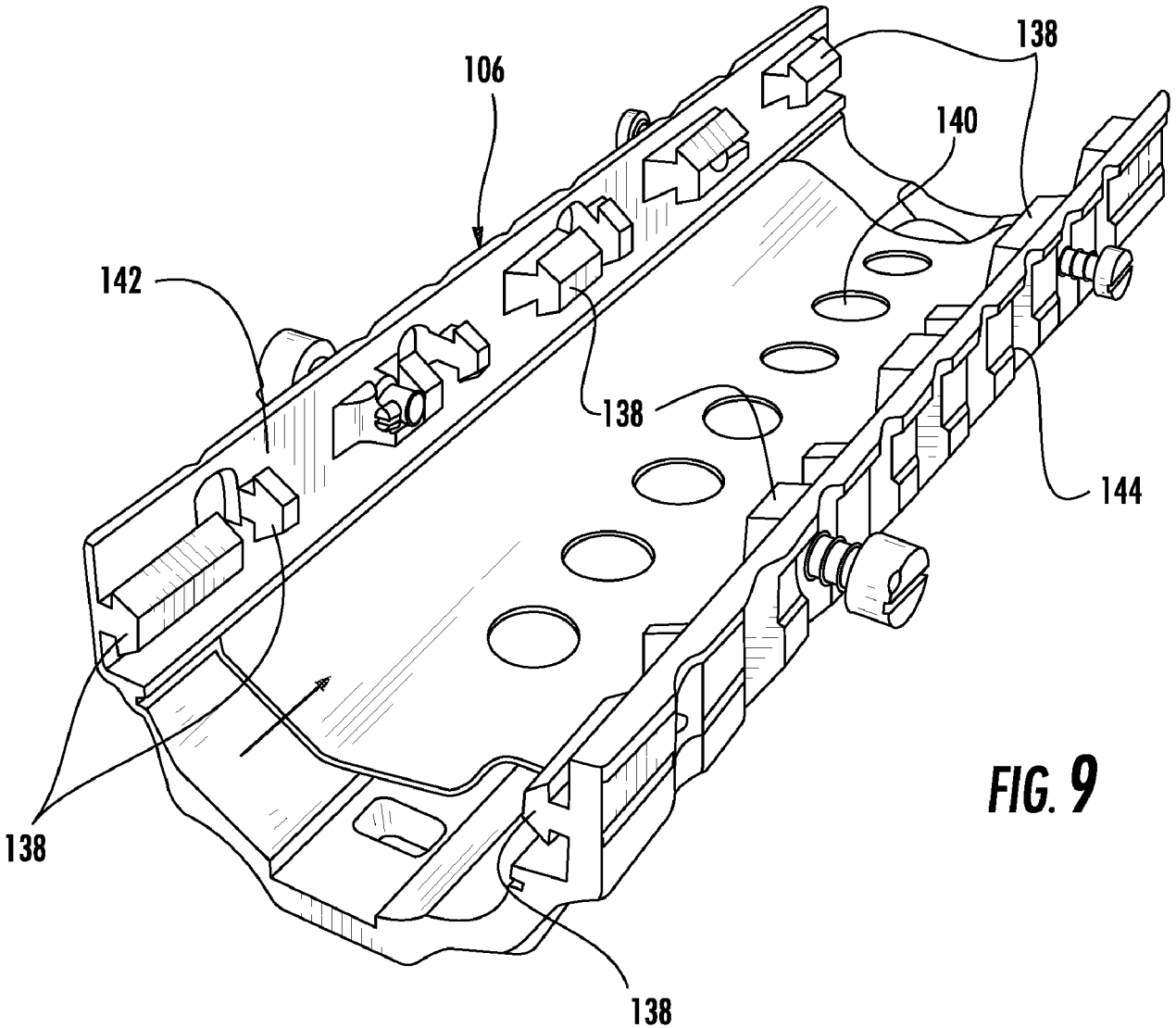
FIG. 9 is a perspective view of the lower hand guard.

Turning now to FIG. 9, the lower firearm accessory 106 may comprise any one of many different types of accessories, such as lower hand guard 106 as shown in the preferred embodiment, or a grenade launcher 106A as shown in FIGS. 11-14. Generally, the lower firearm accessory 106 includes symmetrically opposing mating formations for removably securing the lower firearm accessory 106 to the mounting channels 114,116 on the upper hand guard 102. In the preferred embodiments as described herein, the mating formations comprise generally T-shaped projections 138 that are slidably received within the mounting channels 114,116.

The preferred hand guard 106 of the present invention is illustrated in detail in FIG. 9. The lower hand guard 106 includes a lower wall 140 and outwardly and upwardly extending symmetrical sidewalls 142,144. The mating projections 138, as described above, extend inwardly from the opposing sidewalls 140,142 for mating engagement with the mounting channel 114A, 116A of the upper hand guard 1-2. In this regard, the lower walls of the mounting channels 114, 116 are provided with interrupted wall segments 114A, 116A to make the upper hand guard 102 compatible with lower hand guards of prior rail systems as produced by the applicant. However, the system 100 need not include the interrupted wall segments. The removable hand guard system, including the interrupted wall segments and interrupted lug projections, is described in greater detail in U.S. Pat. No. 6,499,245, the entire contents of which are incorporated herein by reference.

Turning to FIGS. 10 and 10A, the optional dovetail sleeve 108 is configured and arranged for clamping onto the aligned dovetail rails 30,112 of the upper receiver 14 and upper hand guard 102. The dovetail sleeve 108 comprises a main body portion 146 having an upper and lower surface, and further includes a clamping bar 148. The upper surface of the sleeve 108 includes a mil-std 1913 dovetail rail 150 to provide an elevated optics platform while the lower surface includes a dovetail channel 152 that rigidly clamps over the aligned dovetail rails 30,112 of the upper receiver 14 and upper hand guard 102 to prevent rotation of the upper hand guard 102 relative to the upper receiver 14 in the event of an impact. The dovetail sleeve 108 is intended to be tilted onto the dovetail rails 30,112 and then clamped. In this regard, one side of the lower channel is provided with a dovetail relief 152, while the interior surface of the opposing side is a flat sidewall 146. The inner surface 158 of the clamping bar 148 provides the opposing inner dovetail relief. Accordingly, the dovetail sleeve 108 can be tilted onto the rails 30,112 and then clamped tight with the side clamping bar 148. The clamping bar is secured with fasteners 160,162 that extend through the body 146. It should also be noted that the outer side surface of the clamping bar 148 is provided with a vertically oriented dovetail rail 164 so as to provide an additional mounting point for optional integrated power systems. Further details of the dovetail sleeve and clamping bar can be found in U.S. Pat. No. 6,499,245 cited hereinabove.

The front end of the dovetail sleeve 108 is further secured to the upper handguard 102 by a threaded fastener 159 that extends downwardly through an opening 159*a* in the top of the sleeve 108 and into a corresponding threaded aperture 159*b* in the top surface of the handguard 102 (see FIGS. 8, 8A and 8B for location of hole 159*b*).

Figure 11:
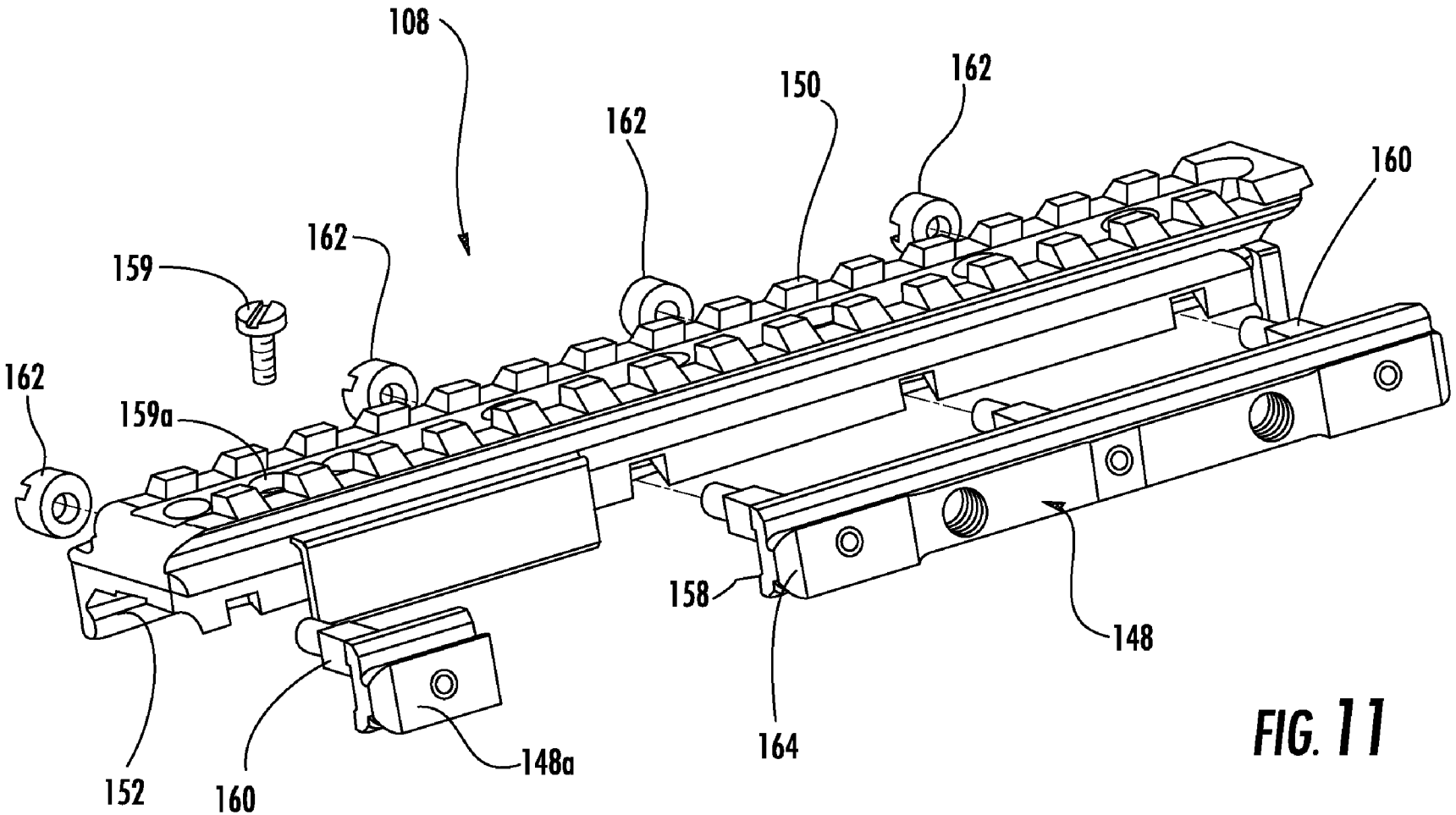
FIG. 11 is an exploded perspective view of an alternate embodiment of the optional dovetail sleeve.
Figure 11A:
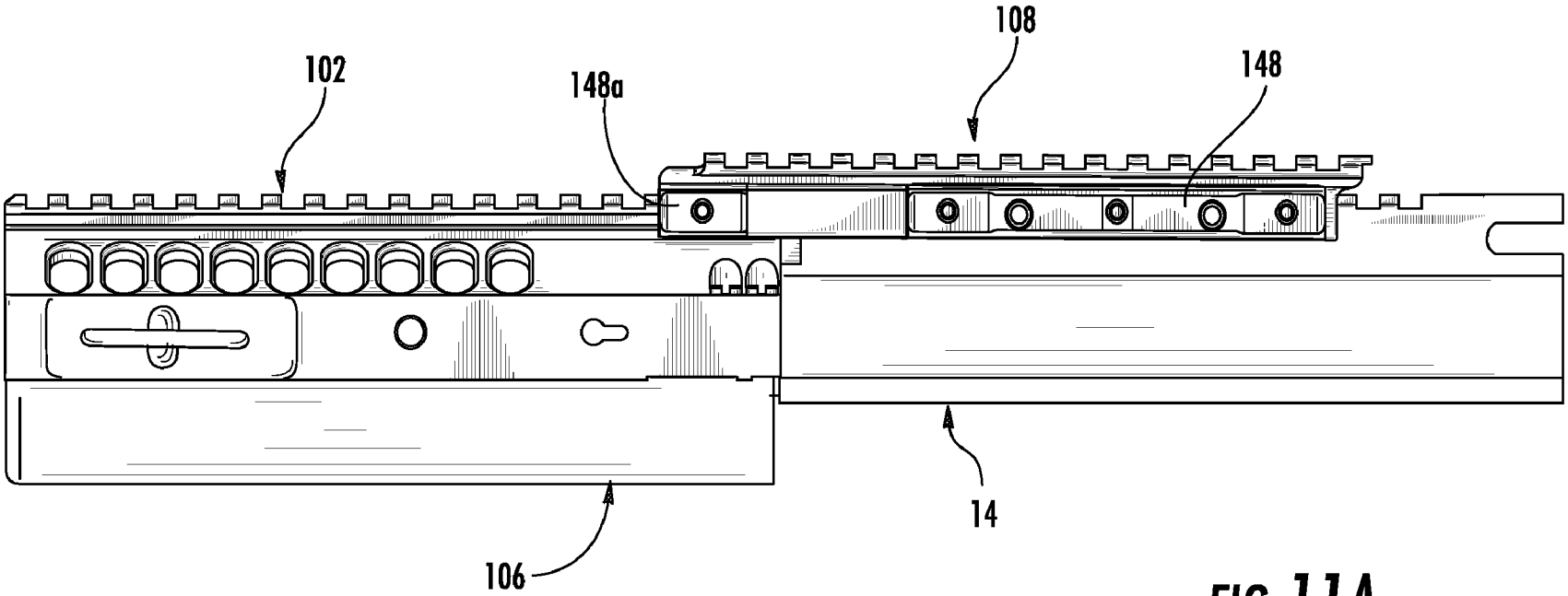
FIG. 11A is a side view thereof.
Figure 12:
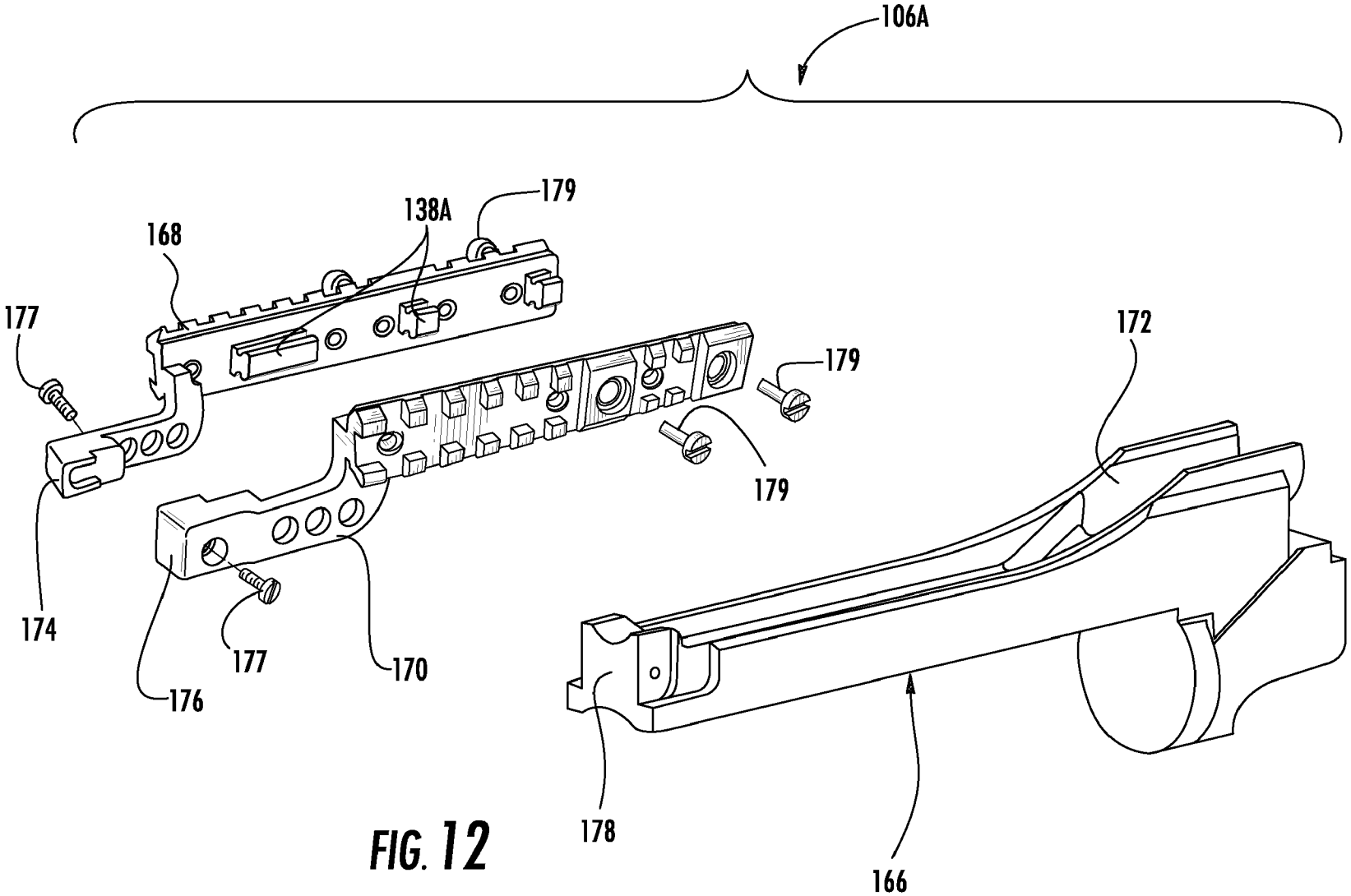
FIG. 12 is a perspective view of a grenade launcher accessory configured for mounting onto the upper hand guard.
Figure 13:
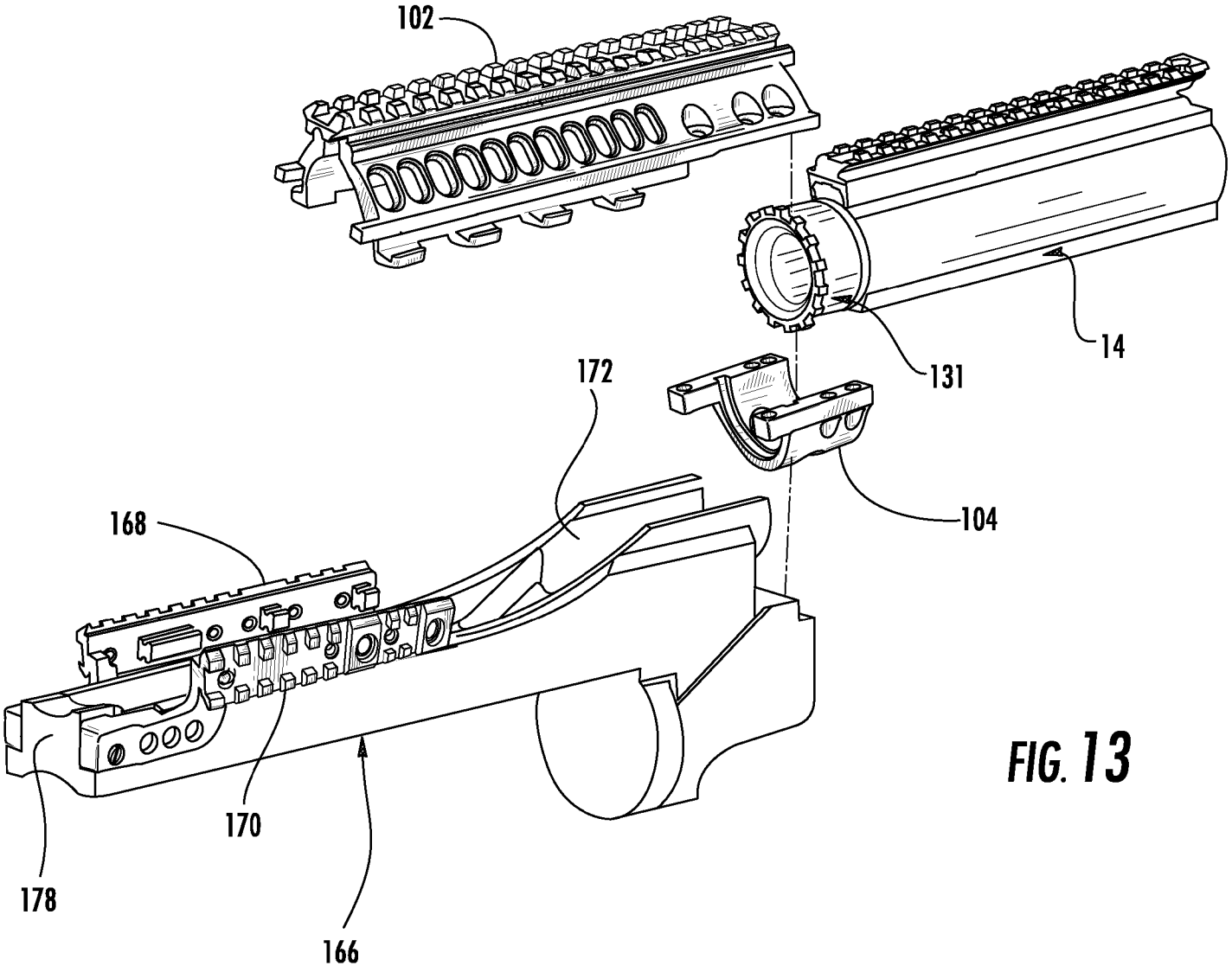
FIG. 13 is an exploded perspective view thereof showing orientation with the upper hand guard and upper receiver.
Figure 14:
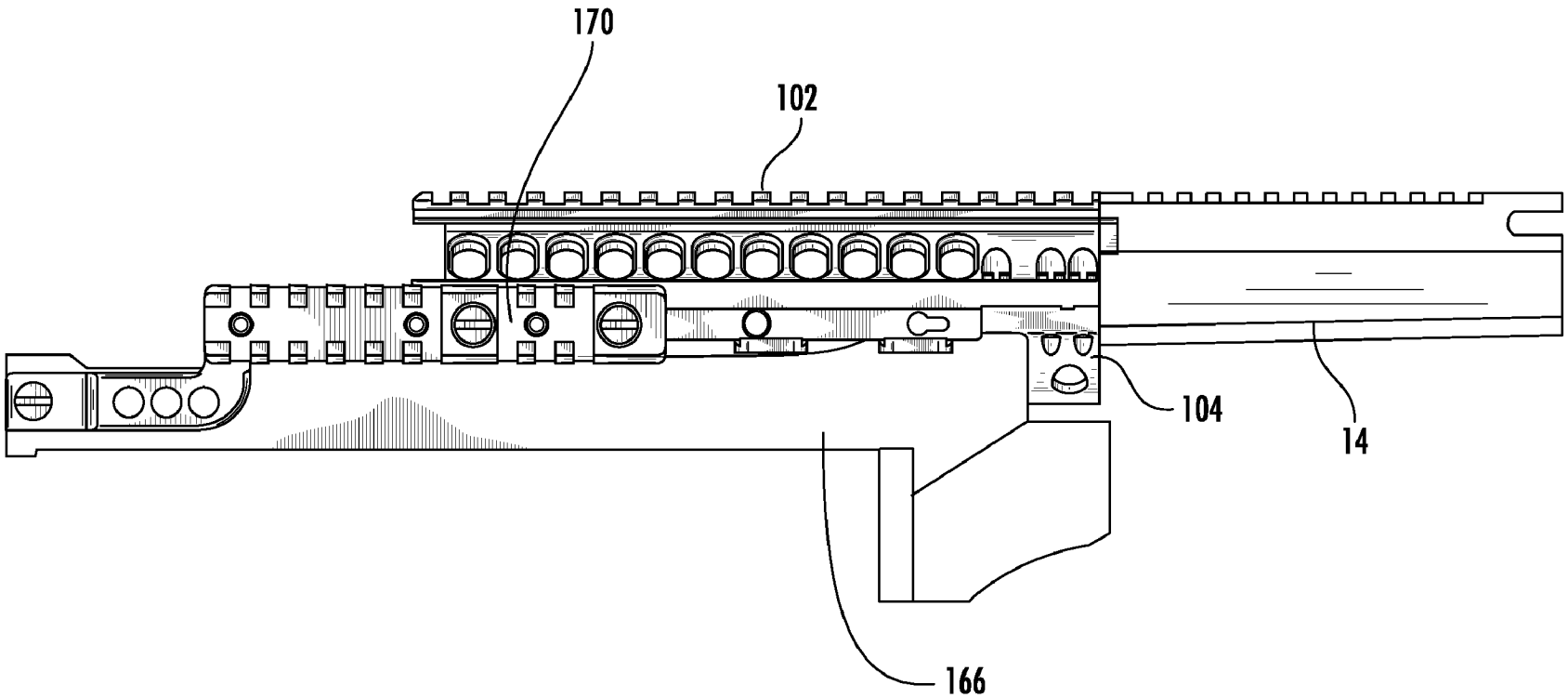
FIG. 14 is an assembled side view thereof.
Figure 15:
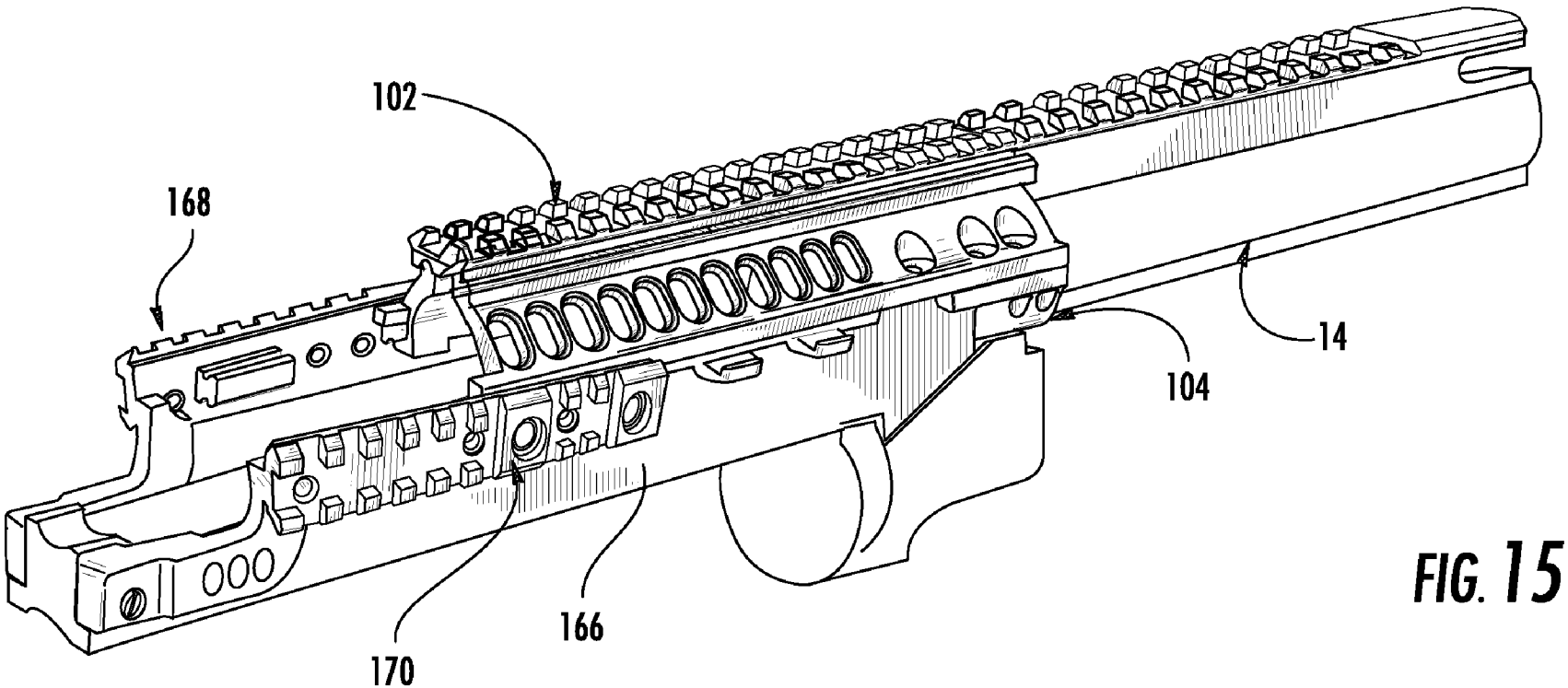
FIG. 15 is an assembled perspective view thereof.

Referring to FIGS. 11 and 11B, the front end of the sleeve 108 can alternatively be secured to the upper handguard 102 using an additional clamping bar 148*a*, fastener 160 and nut 162.

It is also contemplated that the optional sleeve 108 can be utilized as an additional temporary alignment guide, wherein it is engaged with the top rail 112 on the upper hand guard 102 and the rail 30 on the upper receiver 14 to hold the upper hand guard 102 in proper linear and rotational alignment as the hand guard 102 is being attached to the firearm. In this case, once the installation of the hand guard 102 is completed, the optional sleeve 108 may be removed. Since the sleeve 108 is tilted onto the upper rails 30,112, it is particularly useful in these applications because it can be installed onto or removed from the firearm without requiring that either the front or rear site first be removed from the firearm. Generally, prior art sleeves, which do not tilt on, would require removal of one or more sights from the upper rail 30.

Turning to FIGS. 12-15, an alternative lower firearm accessory, i.e. M203 grenade launcher is illustrated and generally indicated at 106A. The grenade launcher accessory 106A utilizes the same upper hand guard 102 and clamp 104, and is intended to be a device that can be quickly mounted and/or easily interchanged with the lower hand guard 106. The grenade launcher 106A comprises a grenade launcher receiver body 166, and opposing adapter arms 168,170. The rearward end of the grenade launcher receiver body 166 includes a flared receptacle 172 that is received around rear end of the barrel 18. The forward end of the receiver body 166 is supported by the adapter arms 168,170. The forward ends of the adapter arms 168,170 each include a bracket 174,176 that is secured to the forward end 178 of the receiver body 166 using fasteners such as screws 177. The rearward ends of the adapter arms 168, 170 include inwardly projecting mating formations, i.e. mating projections 138A, that are slidably received into the mounting channels 114,116 of the upper hand guard 102. Additional fasteners 179 may be provided to engage the mounting channels 114, 116 and prevent the adapter arms 168, 170 from sliding once installed When assembled with the upper hand guard 102, the weight of the grenade launcher system 106A is supported on the upper hand guard 102.

As one skilled in the art may appreciate, any accessory device 106 that is formed to include the necessary projections 138 to interface with the mating mounting channels 114,116 on the upper hand guard can be mounted to the upper hand guard 102 in the same fashion.

Accordingly, the present invention provides a new and improved modular integrated rail system for mounting a modular accessory onto a firearm without attaching either the rail system of the accessory directly to the gun barrel. The present invention further provides a modular integrated rail system that supports the accessories without introducing loads or additional stresses into the barrel of the firearm while including an extended longitudinal rail for mounting accessories that is co-planar and aligned with the existing interface rail on the upper receiver over the entire length of the top of the firearm. Finally, the present invention provides an optional sleeve to be mounted over the receiver for added height if desired. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A modular integrated rail system for a firearm, said firearm comprising an upper receiver, said upper receiver comprising a dovetail rail extending longitudinally between a forward end and a rearward end thereof, said upper receiver still further comprising a barrel receiving receptacle at said forward end thereof, said firearm further comprising a barrel received in said barrel receiving receptacle and a barrel nut received around said barrel receiving receptacle to retain said barrel within said barrel receiving receptacle, said barrel nut comprising a cylindrical outer surface, said modular integrated rail system comprising:

an upper hand guard having a dovetail rail extending longitudinally between a forward end and the rearward end thereof;

a clamp removably secured to said rearward end of said upper hand guard, said rearward end of said upper hand guard and said clamp each comprising a clamping surface configured and arranged to cooperatively engage said cylindrical outer surface of said barrel nut and thereby support said upper hand guard on said barrel nut without engaging said firearm forward of said barrel nut; and alignment tabs extending from said rearward end of said upper hand guard, said alignment tabs being configured and arranged to engage said upper receiver of said firearm whereby said alignment tabs provide rotational alignment of said hand guard to the upper receiver, said upper hand guard extending from said forward end of said upper receiver forwardly above said barrel with said dovetail rail of said upper hand guard in linear alignment with said dovetail rail of said upper receiver.

2. The modular integrated rail system of claim 1 wherein said rearward end of said upper hand guard and said clamp each further comprise a groove configured and arranged to accommodate a toothed flange of said barrel nut.

3. The modular integrated rail system of claim 1 further comprising a lower firearm accessory, said upper hand guard and said lower firearm accessory including interfitting mating formations for removably securing said lower firearm accessory to said upper hand guard.

4. The modular integrated rail system of claim 1, wherein said upper hand guard includes symmetrically opposing side walls that extend outwardly and downwardly from said dovetail rail, said opposing side walls terminating in symmetrically opposing longitudinally extending mounting channels.

5. The modular integrated rail system of claim 4 wherein each of said longitudinally extending mounting channels has an upper wall and a lower wall, and said lower wall comprises a plurality of spaced wall segments.

6. The modular integrated rail system of claim 2 further comprising a lower firearm accessory having symmetrically opposing sidewalls that extend outwardly and upwardly, said symmetrically opposing sidewalls including protrusions that interfittingly engage within said mounting channels.

7. The modular integrated rail system of claim 4 further comprising a lower firearm accessory having symmetrically opposing sidewalls that extend outwardly and upwardly, said symmetrically opposing sidewalls including protrusions that interfittingly engage within said mounting channels, said protrusions comprising a plurality of spaced protrusions that matingly interfit between said spaced wall segments.

8. The modular integrated rail system of claim 6 wherein said lower firearm accessory comprises a lower hand guard.

9. The modular integrated rail system of claim 1 wherein said alignment tabs are integrally formed with said upper hand guard.

10. The modular integrated rail system of claim 1 wherein said alignment tabs engage side walls of said upper receiver beneath said dovetail rail.

11. A modular integrated rail system for a firearm, said firearm comprising an upper receiver, said upper receiver comprising a dovetail rail extending longitudinally between a forward end and a rearward end thereof, said upper receiver still further comprising a barrel receiving receptacle at said forward end thereof, said firearm further comprising a barrel received in said barrel receiving receptacle and a barrel nut received around said barrel receiving receptacle to retain said barrel within said barrel receiving receptacle, said barrel nut comprising a cylindrical outer surface and a toothed flange, said modular integrated rail system comprising:

a hand guard having a dovetail rail extending longitudinally between a forward end and a rearward end thereof; and a clamp removably secured to said rearward end of said hand guard, said rearward end of said hand guard and said clamp each comprising a clamping surface configured and arranged to cooperatively engage a substantial portion of said cylindrical outer surface of said barrel nut and thereby support said hand guard on said barrel nut without engaging said barrel, said hand guard extending from said forward end of said upper receiver forwardly with said dovetail rail of said hand guard in linear alignment with said dovetail rail of said upper receiver.

12. The modular integrated rail system of claim 11 wherein said rearward end of said hand guard and said clamp each further comprise a groove configured and arranged to accommodate a toothed flange of said barrel nut.

13. The modular integrated rail system of claim 10 further comprising alignment tabs extending from said rearward end of hand guard, said alignment tabs being configured and arranged to engage side walls of said upper receiver and to thereby provide rotational alignment of said hand guard to said upper receiver, and further to prevent rotation of said hand guard relative to said upper receiver during use thereof.

14. The modular integrated rail system of claim 12 wherein said alignment tabs are integrally formed with said hand guard.

15. The modular integrated rail system of claim 13 wherein said alignment tabs engage said side walls of said upper receiver beneath said dovetail rail.

16. A modular integrated rail system for a firearm, said firearm comprising an upper receiver, said upper receiver comprising a dovetail rail extending longitudinally between a forward end and a rearward end thereof, said upper receiver still further comprising a barrel receiving receptacle at said forward end thereof, said firearm further comprising a barrel received in said barrel receiving receptacle, and a barrel nut received around said barrel receiving receptacle to retain said barrel within said barrel receiving receptacle, said barrel nut comprising an outer surface and a toothed flange at a forward end thereof, said modular integrated rail system comprising:

a hand guard having a dovetail rail extending longitudinally between a forward end and the rearward end thereof, said rearward end of said hand guard being clamped onto said outer surface of said barrel nut thereby supporting said hand guard on said barrel nut without engaging said firearm forward of said barrel nut; and at least one alignment tab extending from said rearward end of said hand guard, said at least one alignment tab being configured and arranged to engage said upper receive of said firearm whereby said at least one alignment tab provides rotational alignment of said hand guard to the upper receiver, said hand guard extending from said forward end of said upper receiver forwardly with said dovetail rail of said hand guard in linear alignment with said dovetail rail of said upper receiver.

17. The modular integrated rail system of claim 14 wherein said at least one alignment tab is integrally formed with said hand guard.

18. The modular integrated rail system of claim 16 wherein said at least one alignment tab engages a side wall of said upper receiver beneath said dovetail rail.

* * * * *